US007150461B2

(12) United States Patent
Schnuckle et al.

(10) Patent No.: US 7,150,461 B2
(45) Date of Patent: Dec. 19, 2006

(54) FOLDABLE SKATEBOARD

(75) Inventors: Gary Schnuckle, Altadena, CA (US); David A. Powell, Blaine, MN (US)

(73) Assignees: Minson Enterprises Co., Ltd (CN); Stowbiz, LLC, Blaine, MN (US)

( * ) Notice: Subject to any disclaimer, the term of this patent is extended or adjusted under 35 U.S.C. 154(b) by 0 days.

(21) Appl. No.: 10/304,539

(22) Filed: Nov. 26, 2002

(65) Prior Publication Data

US 2003/0127816 A1 Jul. 10, 2003

Related U.S. Application Data

(60) Provisional application No. 60/400,447, filed on Aug. 1, 2002, provisional application No. 60/346,695, filed on Jan. 7, 2002.

(51) Int. Cl.
*A63C 17/02* (2006.01)

(52) U.S. Cl. ..... 280/87.05; 280/87.042

(58) Field of Classification Search ..... 280/87.01, 280/87.021, 87.041, 87.042, 87.03, 87.05, 280/20, 32.6, 79.11, 639, 641, 38, 652; 267/140.2
See application file for complete search history.

(56) References Cited

U.S. PATENT DOCUMENTS

| | | | | | |
|---|---|---|---|---|---|
| 2,692,636 | A | * | 10/1954 | Morrison | 280/32.6 |
| 3,583,722 | A | * | 6/1971 | Jacobson | 280/16 |
| D302,993 | S | | 8/1989 | Heilig | D21/227 |
| 5,029,887 | A | * | 7/1991 | Grutzner et al. | 280/242.1 |
| 5,263,725 | A | * | 11/1993 | Gesmer et al. | 280/11.28 |
| 5,284,352 | A | * | 2/1994 | Chen | 280/276 |
| 5,451,068 | A | * | 9/1995 | Shockley | 280/32.6 |
| 5,494,305 | A | * | 2/1996 | Chen | 280/32.6 |
| 5,505,474 | A | * | 4/1996 | Yeh | 280/87.042 |
| 5,524,915 | A | * | 6/1996 | Liu | 280/30 |
| 5,540,455 | A | * | 7/1996 | Chambers | 280/87.042 |
| 5,551,717 | A | | 9/1996 | De Courcey Milne | 280/87.042 |
| 5,611,552 | A | * | 3/1997 | Miles et al. | 280/32.6 |
| 5,730,449 | A | * | 3/1998 | Miles | 280/32.6 |
| 5,769,438 | A | * | 6/1998 | Svetlov | 280/87.041 |
| 5,803,473 | A | | 9/1998 | Bouden | 280/87.042 |
| 5,816,592 | A | * | 10/1998 | Horton et al. | 280/87.041 |
| 5,826,895 | A | * | 10/1998 | Bradfield | 280/87.042 |
| 5,895,062 | A | * | 4/1999 | Miles et al. | 280/32.6 |
| 5,924,710 | A | | 7/1999 | de Courcey Milne | 280/87.042 |
| 5,997,018 | A | | 12/1999 | Lee | 280/87.042 |
| 6,131,931 | A | * | 10/2000 | Globerson et al. | 280/87.042 |
| 6,286,843 | B1 | * | 9/2001 | Lin | 280/11.28 |
| 6,318,739 | B1 | * | 11/2001 | Fehn, Jr. | 280/11.28 |
| 6,382,646 | B1 | * | 5/2002 | Shaw | 280/87.041 |
| D472,596 | S | * | 4/2003 | Schnuckle et al. | 280/87.042 |
| D473,905 | S | * | 4/2003 | Schnuckle et al. | 280/87.042 |
| 6,616,154 | B1 | * | 9/2003 | Neuhold | 280/87.05 |
| 6,733,026 | B1 | * | 5/2004 | Robberson et al. | 280/415.1 |
| 6,981,711 | B1 | * | 1/2006 | Seta | 280/87.05 |
| 2002/0089137 | A1 | * | 7/2002 | Chang et al. | 280/87.041 |

* cited by examiner

*Primary Examiner*—Jeff Restifo
(74) *Attorney, Agent, or Firm*—Westman, Champlin & Kelly

(57) ABSTRACT

A skateboard comprising an articulated structure having a foot platform, at least one forward and one rearward ground engaging wheel. The articulated structure is foldable between a skating position and a folded position. With the skateboard in the skating position, the axis of the forward wheel, the axis of the rearward wheel and the foot platform lie substantially within the same plane.

38 Claims, 19 Drawing Sheets

FOLDABLE SKATEBOARD

CROSS-REFERENCE TO RELATED APPLICATION(S)

Applicant claims priority of U.S. Provisional Application No. 60/346,695, filed Jan. 7, 2002, and U.S. Provisional Application No. 60/400,447, filed Aug. 1, 2002.

BACKGROUND OF INVENTION

The present invention relates to skateboard devices. In particular, the present invention relates to a foldable skateboard.

A conventional skateboard typically consists of a rigid deck with front and rear truck assemblies attached thereto. A user stands upon the deck, and can control the direction in which the skateboard is traveling by shifting weight to certain places about the board. In most cases, the truck assemblies are located directly beneath the deck, which inherently results in the deck being positioned higher than axes of the wheels of the truck assemblies. This raises the user's center of gravity upon mounting the skateboard. By lowering the deck such that it lies in the same plane in which the axes of the wheels lie, the user's center of gravity is kept closer to the ground, resulting in the skateboard becoming more stable and maneuverable.

Conventional skateboards are also by their nature bulky and difficult to carry when not in use. An example of this type of problem is the banning of skateboards at convenience stores not only because the owner's of such stores do not want the skateboards to be ridden in the store, but also because the skateboards can knock items off of shelves and counters if the child is not paying attention to how he or she is carrying the skateboard. The same type of problem exists at households where children are careless when carrying the skateboard, and due to its bulkiness, accidentally knock the skateboard into household objects, which leads either to their damage or destruction.

Another problem associated with conventional skateboards is storage. Due to their bulkiness, conventional skateboards tend to take up considerable storage space. Alternatively, if not stored properly, skateboards may be accidentally stepped on causing an injury to the person.

BRIEF SUMMARY OF INVENTION

The present invention includes an articulated skating apparatus positionable between a skating position and a folded position. The articulated skating apparatus includes a forward portion and a rearward portion pivotally attached to a cradle. The cradle includes a foot platform for resting at least one foot of a user thereon. While in the folded position, the forward portion and the rearward portion pivot into and nest within the cradle. Both the forward portion and the rearward portion include a wheel assembly having at least one ground engaging wheel. While in the skating position, an axis of at least one forward ground engaging wheel, an axis of at least one rearward ground engaging wheel and the foot platform all lie substantially within the same plane. A cable assembly attachable to the forward portion and the rearward portion provides semi-rigid support to the articulated skating apparatus. The articulated skating apparatus further comprises a steering dampening assembly for selectively controlling the steering of the articulated skating apparatus.

DETAILED DESCRIPTION

Figure 1:
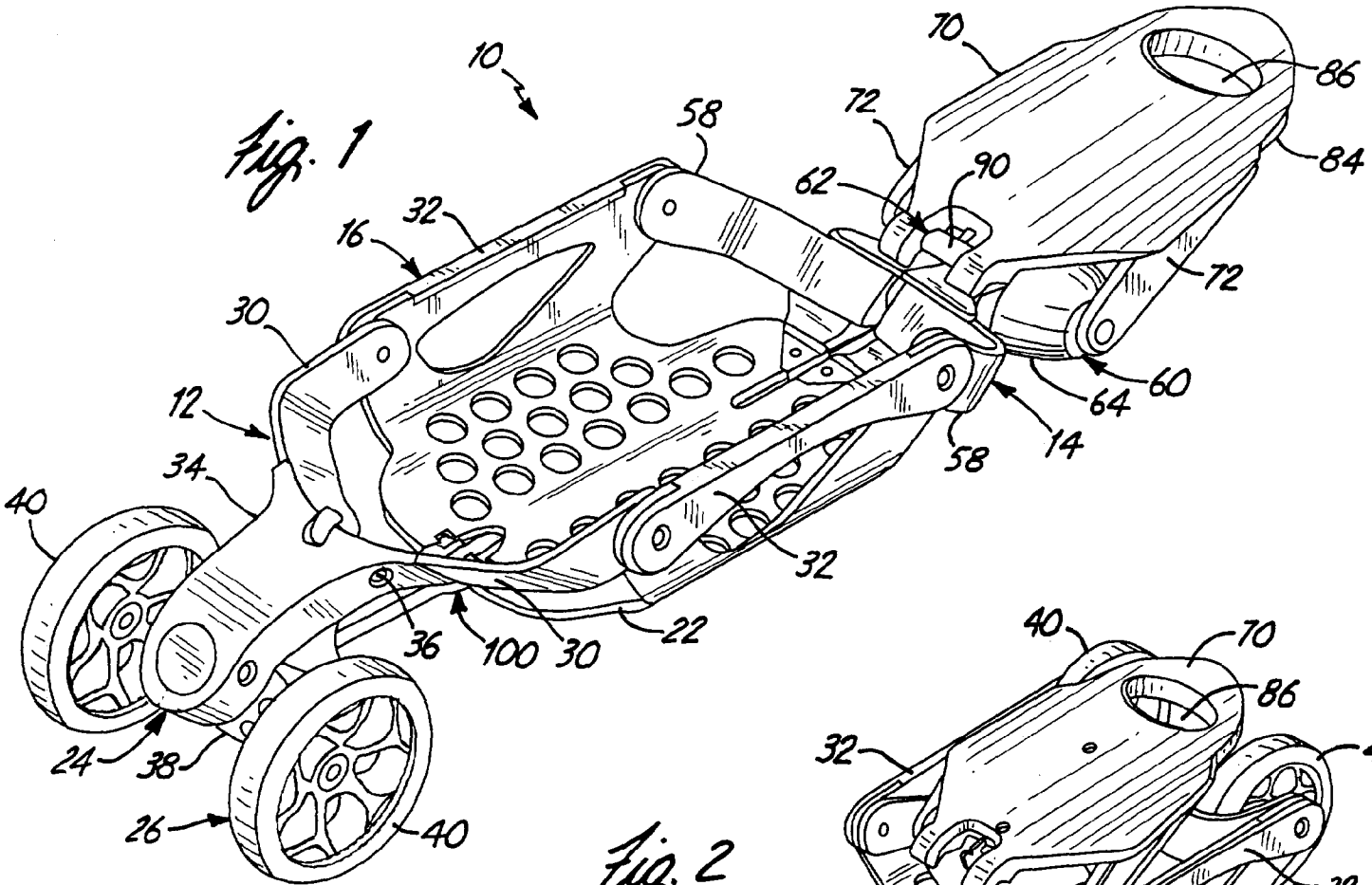
FIG. 1 is a perspective view of a preferred embodiment of the present invention in an unfolded skating position.
Figure 2:
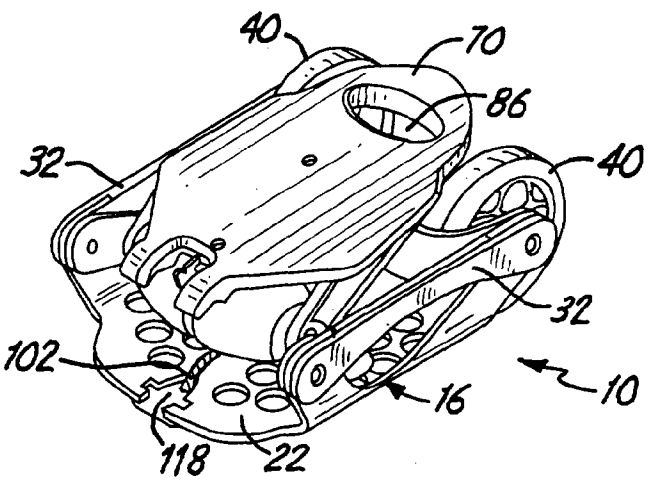
FIG. 2 is a perspective view of the preferred embodiment of the present invention in a folded position.
Figure 3:
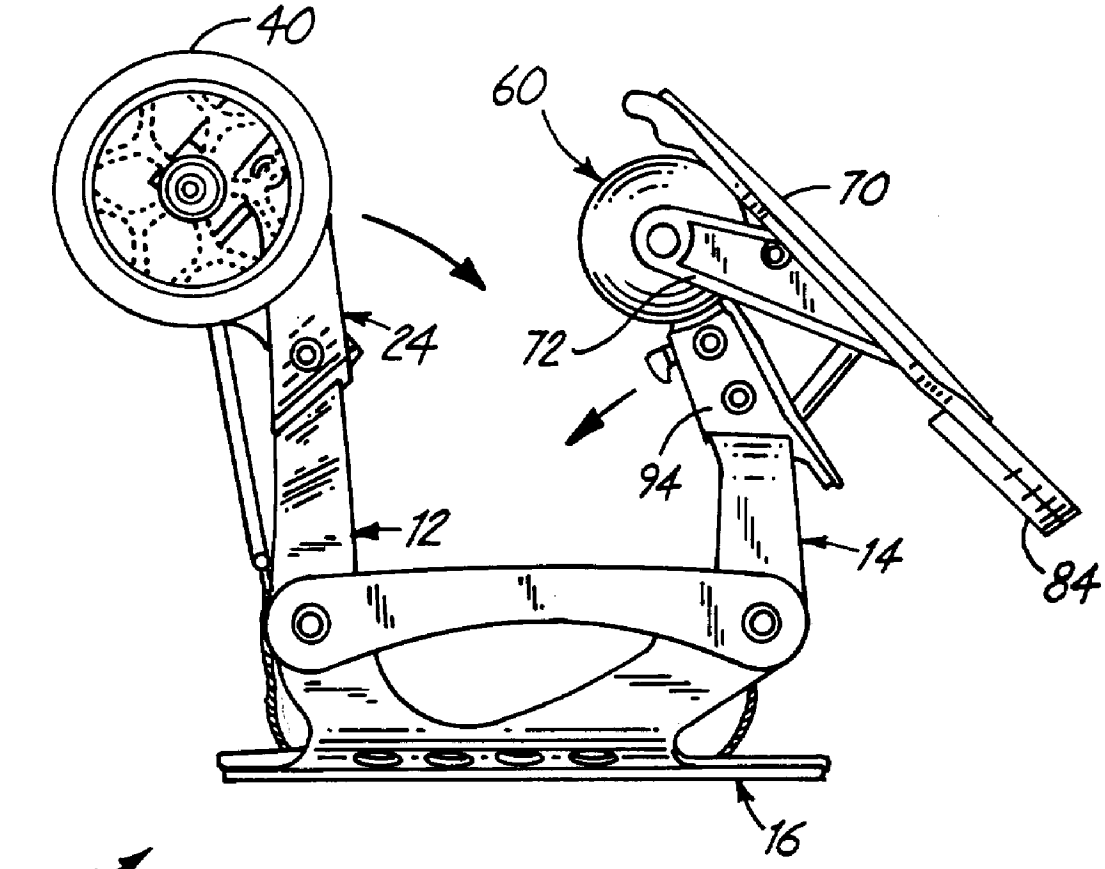
FIG. 3 is a side view of the preferred embodiment of the present invention being positioned from the unfolded position to the folded position.
Figure 4:
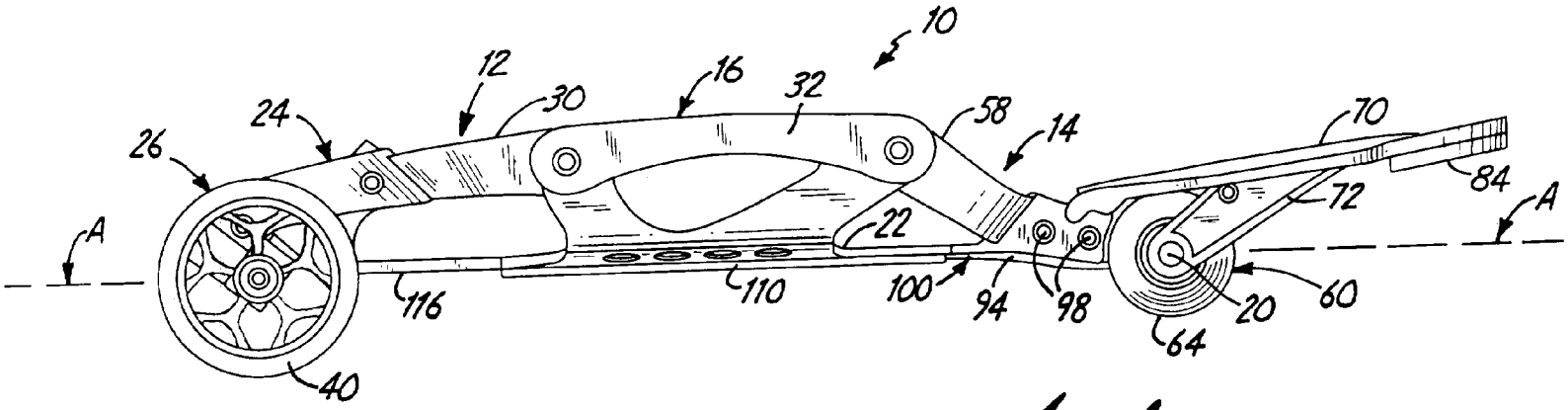
FIG. 4 is a side view of the preferred embodiment of the present invention.
Figure 5:
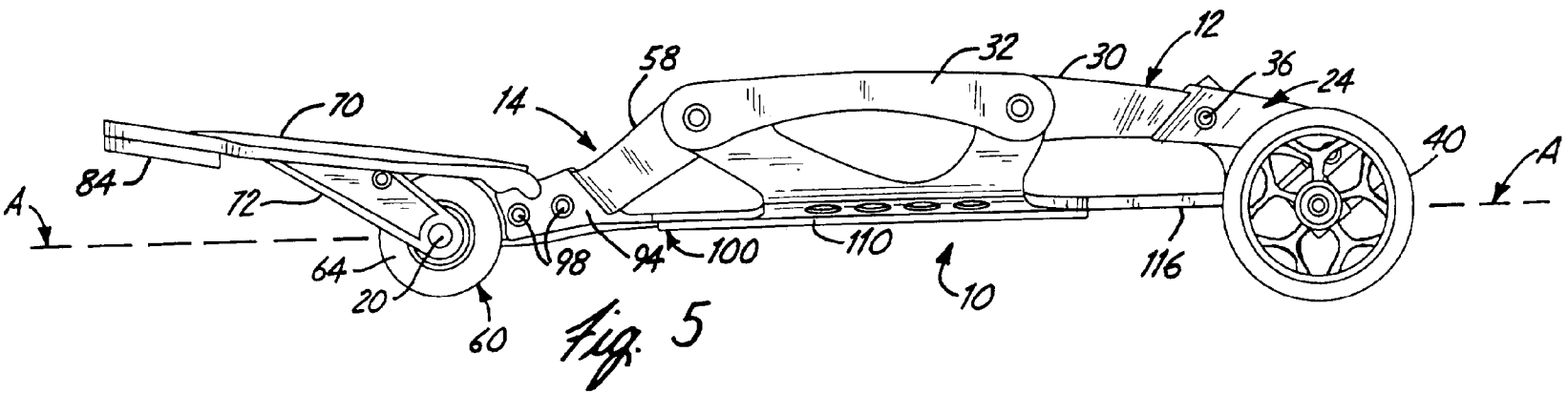
FIG. 5 is a side view of the preferred embodiment of the present invention.

A preferred embodiment of an articulated skating apparatus according to the present invention is generally indicated at 10 in FIGS. 1 and 2. The articulated skating apparatus 10 of the present invention generally comprises a neck assembly 12 and a tail assembly 14 pivotally attached to a cradle 16. The articulated skating apparatus 10 is positionable between a first unfolded skating position, as illustrated in FIG. 1, and a second folded position, as illustrated in FIG. 2. FIG. 3 illustrates the articulated skating apparatus being positioned from the first unfolded position to the second folded position. In the first unfolded position, both the neck assembly 12 and the tail assembly 14 are positioned such that a front axle 18, a rear axle 20 and a deck 22 are positioned substantially within a plane A—A as illustrated in FIGS. 4 and 5. By being positioned substantially within the plane A—A, it is meant that the front axle 18 and the rear axle 20 lie approximately within the same plane A—A as defined by the deck 22. The deck 22 supports at least one foot of the user, and thus the center of gravity of the articulated skating apparatus 10 coincides with the front and rear axles, 18 and 20.

Figure 6:
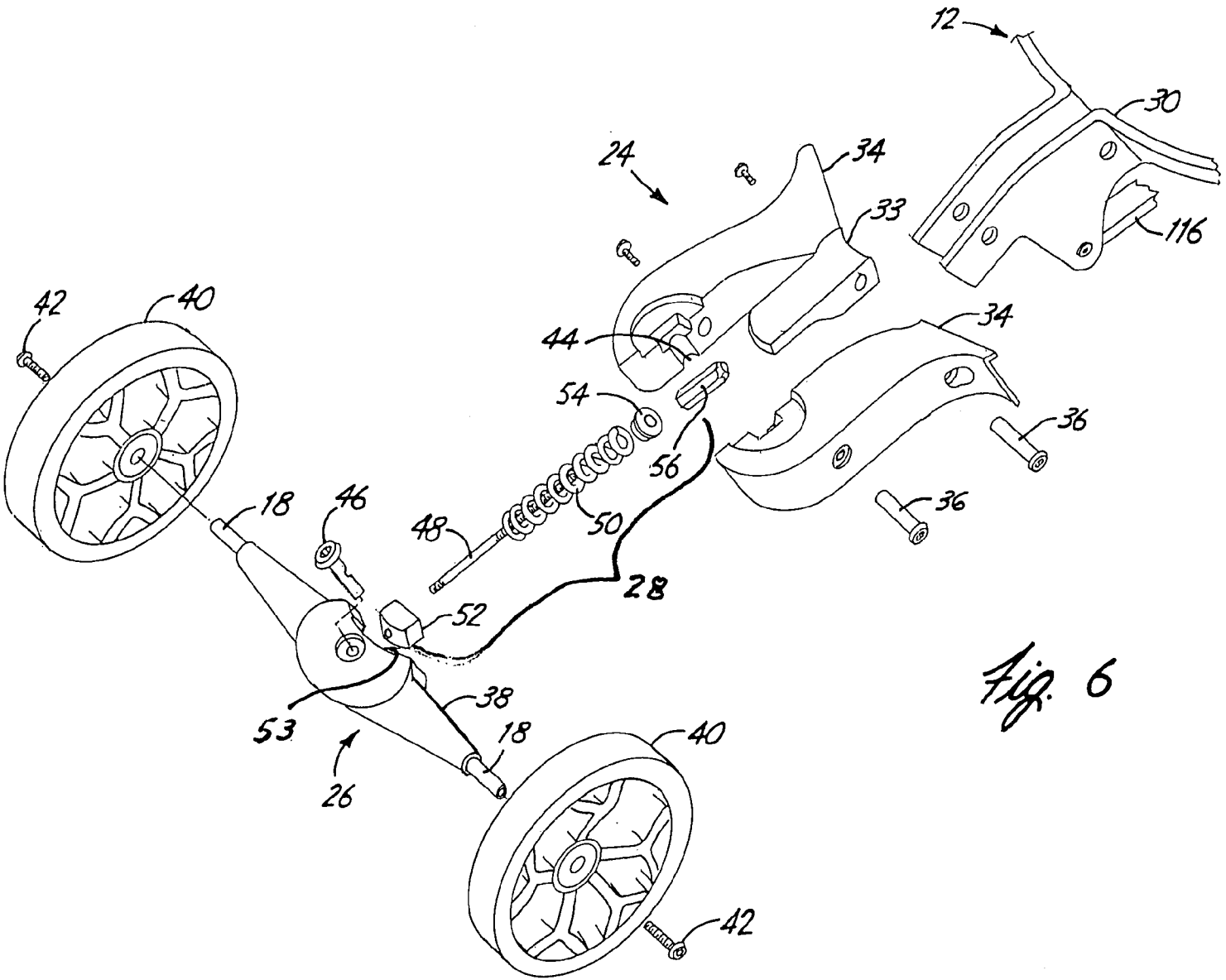
FIG. 6 is an exploded perspective view of a forward portion of the preferred embodiment of the present invention.

The neck portion 12 of the skating apparatus 10 comprises a nose assembly 24, a truck assembly 26, and a steering dampener assembly 28. The nose assembly 24 includes support arms 30 pivotally attached to truss members 32 of the cradle 16. As illustrated in FIG. 6, positioned between each support arm 30 is a spacer block 33. Attached to each support arm 30 are nose members 34. The nose members 34 enclose the spacer block 33 and fixedly attach to the respective support arms 30 with attaching bolts 36. Each nose member 34 provides additional support to the nose assembly 24, which also houses the steering dampener 28 assembly.

The truck assembly 26 includes a truck housing 38 for supporting the front axle 18. Attached to opposing ends of the front axle 18 are wheels 40 secured by screws 42. The truck housing 38 further includes a medial aperture 44 therethrough, positioned transverse to the front axle 18, for receiving an attachment means to pivotally secure the truck assembly 26 to the nose assembly 24. Pivotally securing the truck assembly 26 to the nose assembly 24 assists in maneuvering or directing the skating apparatus 10 in a particular direction. Additionally, each forward wheel 40 is independently rotatable, which further assists in turning and maneuvering.

To control the ease at which to steer or maneuver the articulated skating apparatus 10 of the present invention, the steering dampener 28 is provided. The steering dampener 28 includes a nose shaft 46, a damper rod 48, a damper spring 50, a damper bumper 52, a damper spacer 54 and a damper nut 56. The nose shaft 46 nests within the medial aperture 44 of the truck housing 38, pivotally securing the damper rod 48 to the truck housing 38. The damper rod 48 threadably engages the nose shaft 46. The damper bumper 52 and the damper spring 50 slidably engage the damper rod 48. The damper spring 50 urges the damper bumper 52 into engagement with an outside semi-circular surface 53 of the truck housing 38. Securing the damper bumper 52 and the damper spring 50 to the damper rod 48 are the damper spacer 54 and the damper nut 56. The damper nut 56 threadably engages the damper rod 48, and by selectively adjusting the damper nut 56, the force needed to steer the articulated skating apparatus 10 can be modified. Because the truck assembly 26 pivots about the nose shaft 46 inserted through the medial aperture 44 of the truck housing 38, rotating the truck assembly 26 assists in cornering and maneuvering the skating apparatus 10. However, depending upon the desired use of the skating apparatus 10, it may be desirable to modify the amount of force needed to pivot the truck assembly 26.

The steering dampening assembly 28 is designed to selectively control the ease at which the truck assembly 26 can be rotated with respect to the nose assembly 24. Upon pivoting from a neutral position, the truck housing 38 urges the damper bumper 52 away from the nose shaft 46. The damper bumper 48, however, is also urged in the opposite direction against the truck housing 38 by the damper spring 50, which is disposed between the damper bumper 52 and the secured damper spacer 54. Increasing the rotation of the truck assembly 26 away from the neutral position requires increasingly greater force as the damper spring 50 exerts greater force onto the damper bumper 52 and subsequently onto the truck housing 38. To selectively modify this force, the damper nut 56 is rotated to urge the damper spacer 52 along the damper rod 48. The force of the damper spring 50 is increased by rotating the damper nut 56 in a clockwise direction, which causes the damper spacer 54 to travel toward the truck housing 38. The force of the damper spring 50 is decreased by rotating the damper nut 56 in a counter-clockwise direction, which causes the damper spacer 54 to travel away from the truck housing 38. It should be understood, though, that this depends upon the threading of the damper rod 48 and the damper nut 56, and reversing the directions by which to increase or decrease the depth of the damper spacer 54 is well within the scope of the present invention.

Figure 7:
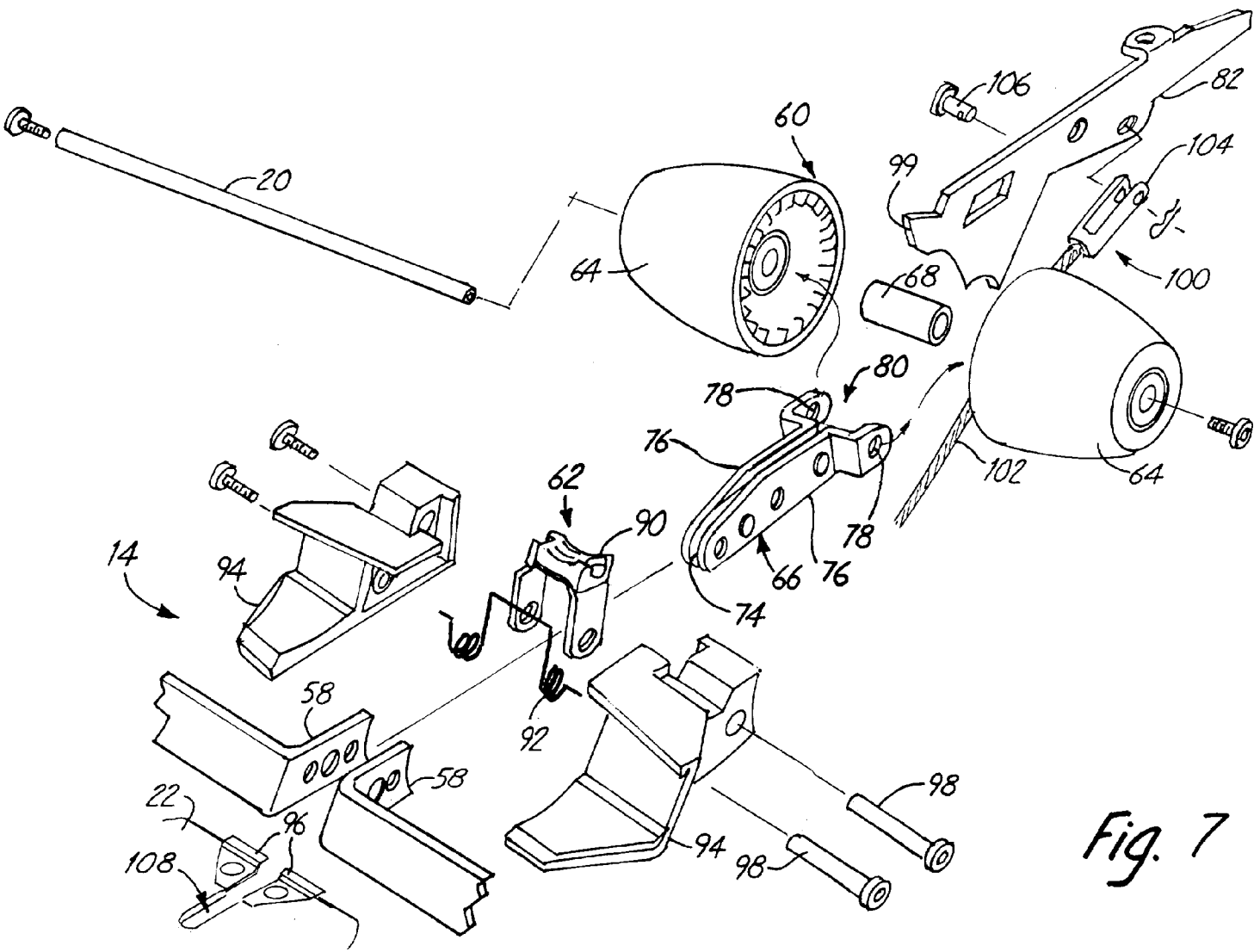
FIG. 7 is an exploded perspective view of a rearward portion of the preferred embodiment of the present invention.

As described, the tail assembly 14 can pivot about the cradle 16 of the skating apparatus 10. Strut members 58 of the tail assembly 14 pivotally attach to the truss members 32 of the cradle 16. The strut members 58 extend away from the cradle 16, eventually curving toward one another. As best illustrated in FIG. 7, the tail assembly 14 further includes a rear wheel assembly 60 and a latching mechanism 62. The rear wheel assembly 60 includes rear wheels 64 disposed on the rear axle 20, an axle sleeve 68 disposed within the axle support 66 for receiving the rear axle, an axle support 66 connecting the rear axle 20 to the strut members 58, and a tail plate 70 rotatably supported by arms 72 disposed on terminal ends of the rear axle 20. The axle support 66 includes a center member 74 disposed between flanged arms 76. The flanged portion of each arm 76 includes an aperture 78 therethrough, and forms a clevis 80. The axle sleeve 68 is disposed within the clevis 80.

Figure 8:
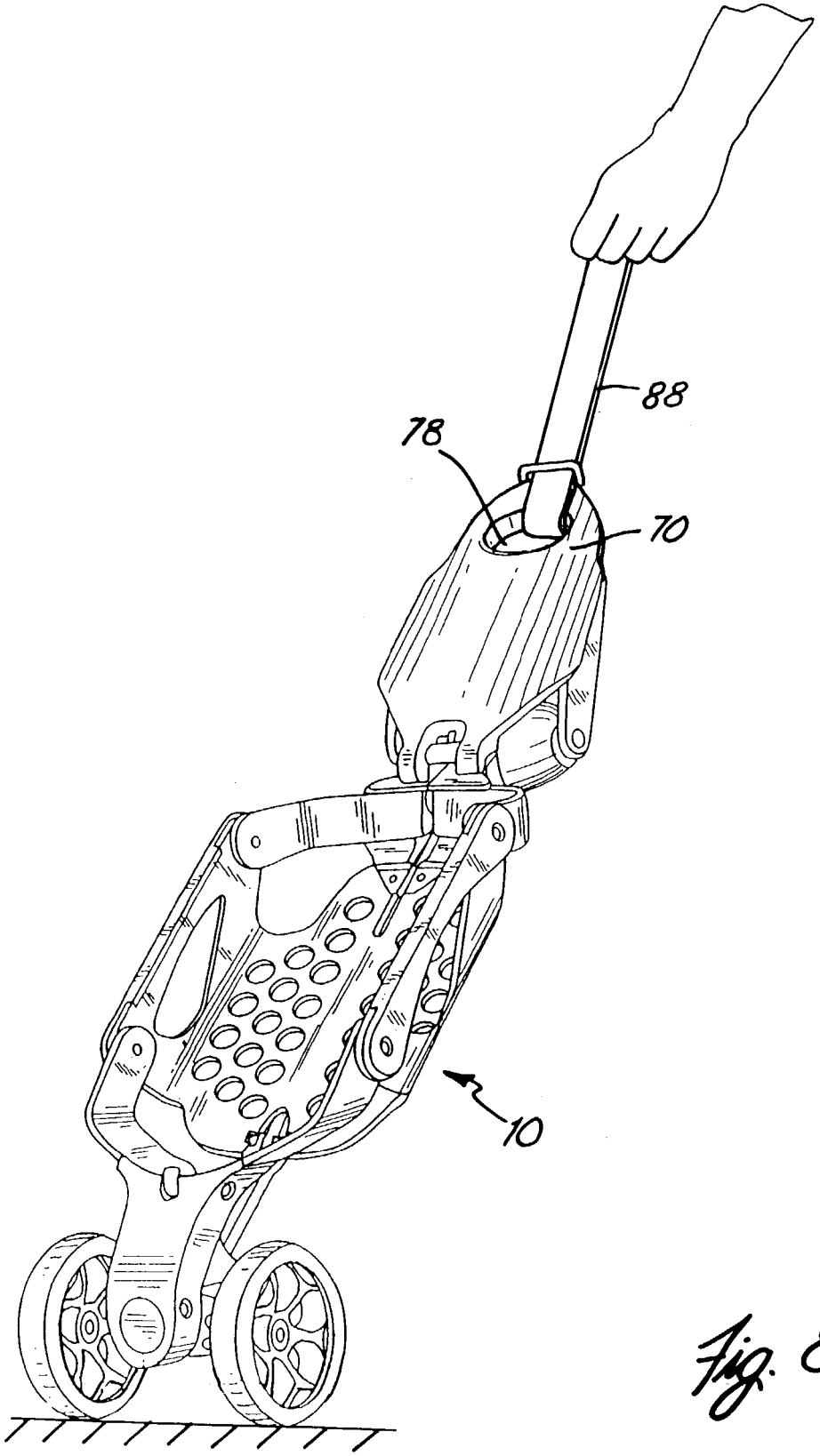
FIG. 8 is a perspective view of the preferred embodiment of the present invention being toted by a strap.
Figure 9:
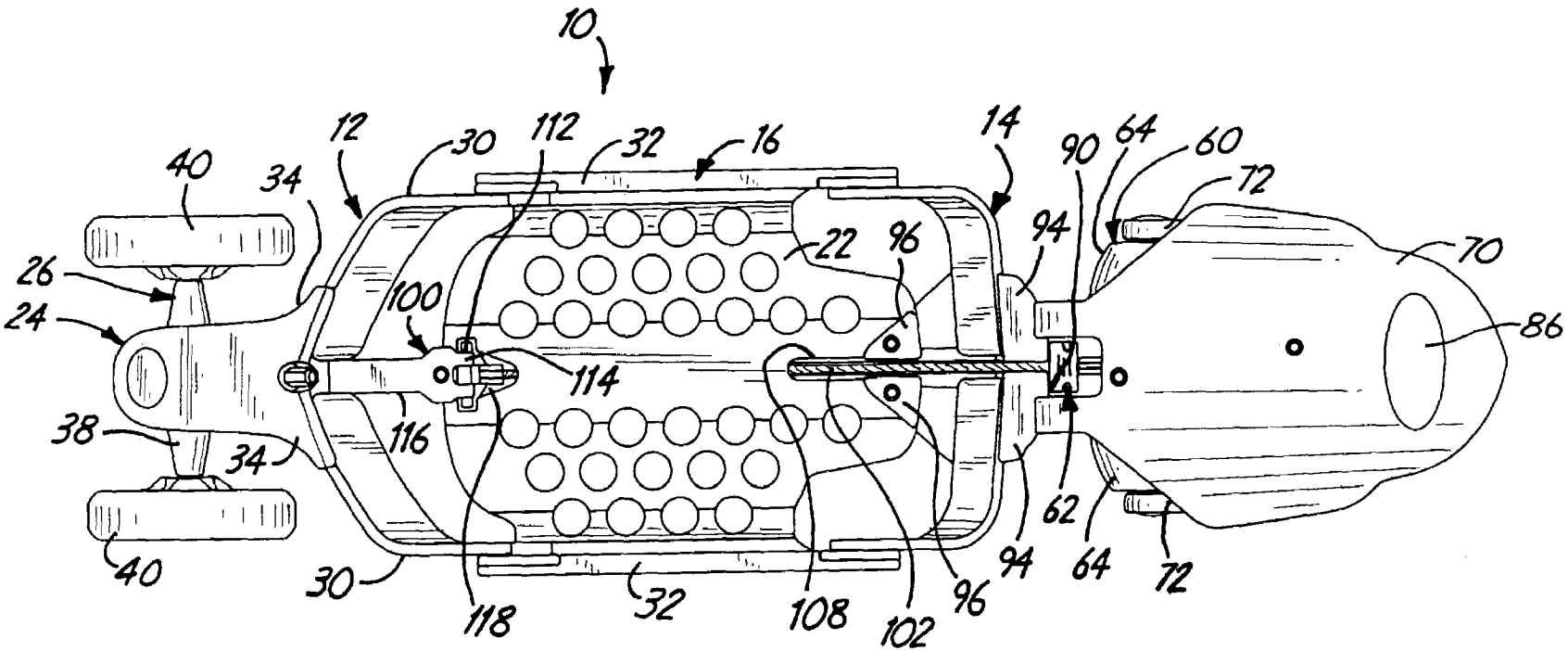
FIG. 9 is a top view of the preferred embodiment of the present invention.
Figure 10:
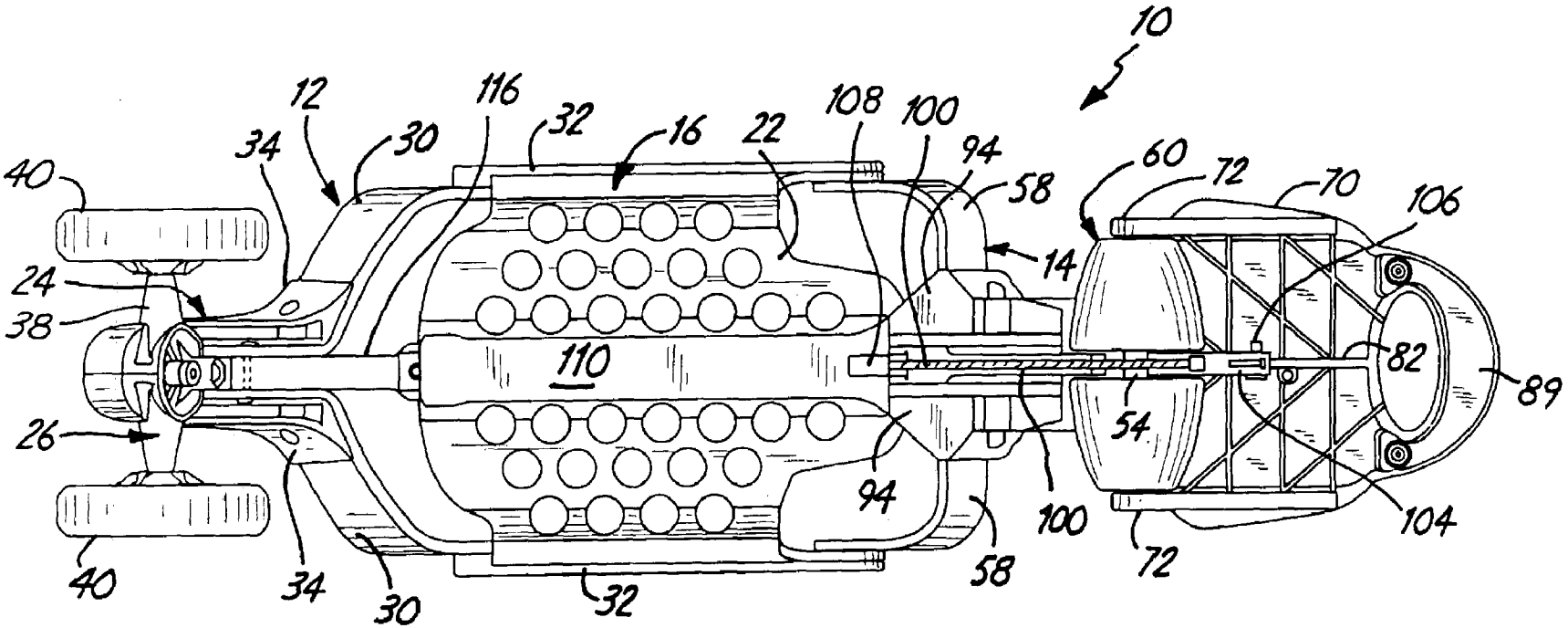
FIG. 10 is a bottom view of the preferred embodiment of the present invention.

The tail plate 70 includes a support rib 82 centrally disposed along a longitudinal axis of the skating apparatus 10. In conjunction to the support rib 82 providing rigidity to the tail plate 70, the support rib 82, is also utilized in the latching mechanism 62. The tail plate 70 further includes a skid plate 84 also disposed on the underside of the tail plate 70 which can be used as a braking means when contacting the ground. The tail plate 70 and skid plate 84 each include an aperture 86 therethrough which can be used as a handle when carrying the skating apparatus 10, either while in the folded or unfolded position. Additionally, a strap 88 may be attached through the aperture 86, allowing the skating apparatus 10 to become a toting apparatus, as illustrated in FIG. 8.

Referring again to FIG. 7, the rear wheels 64 are positioned on the rear axle 20 such that the axle sleeve 68 and the axle support 66 are positioned therebetween. Preferably, each rear wheel 64,has a frusto-conical configuration having a greater radius at the center and decreasing outwardly. The slant of the rear wheels 64 works in conjunction with the front truck assembly 26 to assist in the maneuverability of the skating apparatus 10.

The latching mechanism 62 attaches to the axle support 66 and the strut members 58. The latching mechanism 62 locks the skating apparatus 10 into the first open position by latching the tail assembly 14 to the cradle 16 and prohibiting both the neck assembly 12 and the tail assembly 14 from further pivoting. The latching mechanism 62 includes a finger grip 90, a spring 92 to urge the finger grip 90 into placement, leg covers 94 for cooperatively engaging support plates 96 attached to the deck 22 of the cradle 16, and the support rib 82 for engaging the finger grip 90. Pins or screws 98 insert through the finger grip 90, spring 92 and leg covers 94 to secure the latching mechanism 62 to the axle support 66 and strut members 58. The latching mechanism 62 operates by rotating the tail plate 70 such that the support rib 82, attached thereto, travels toward the finger grip 90. Upon engaging, the finger grip 90 is urged away from the support rib 82 which has a declined surface 99. Upon traveling past the declined surface 99, the finger grip 90 is urged back into position by the spring 92, thus locking the tail plate 70. To release the tailplate 70, the finger grip 90 is urged away from the tail plate 70 by hand, and upon the finger grip 90 disengaging from the support rib 82, the tail plate 70 is unlocked. The latching mechanism 62 works in conjunction with a cable assembly 100 to provide rigidity and lock the skating apparatus 10 while in the unfolded skating position.

As illustrated in FIGS. 7, 9–11, the cable assembly 100 includes a cable 102 attached at terminate ends to the neck assembly 12 and the tail assembly 14. A clevis 104 connected to the cable 102 is attached to the support rib 82 of the tail plate 70 with a cooperating clevis pin 106, thus attaching the cable 102 to the tail assembly 14. When in the locked position, the cable 102 rests within a cable guide 108 located on an underside of the deck 22. The cable 102 is protected by a lock plate 110 which is positioned over the cable guide 108 on the underside of the deck 22. The opposing end of the cable 102 includes a ferrel 112 for engaging loops 114 of an attaching bracket 116. The bracket 116 connects to the ferrel 112 and pivotally attaches to the nose assembly 24. The cable assembly 100 works in conjunction with the latching mechanism 62 not only to lock the skating apparatus 10 into the skating position, but to also provide semi-rigid support. Providing semi-rigid support allows the skating apparatus 10 to flex which increases the ease at which to use the skating apparatus 10.

Figure 11:
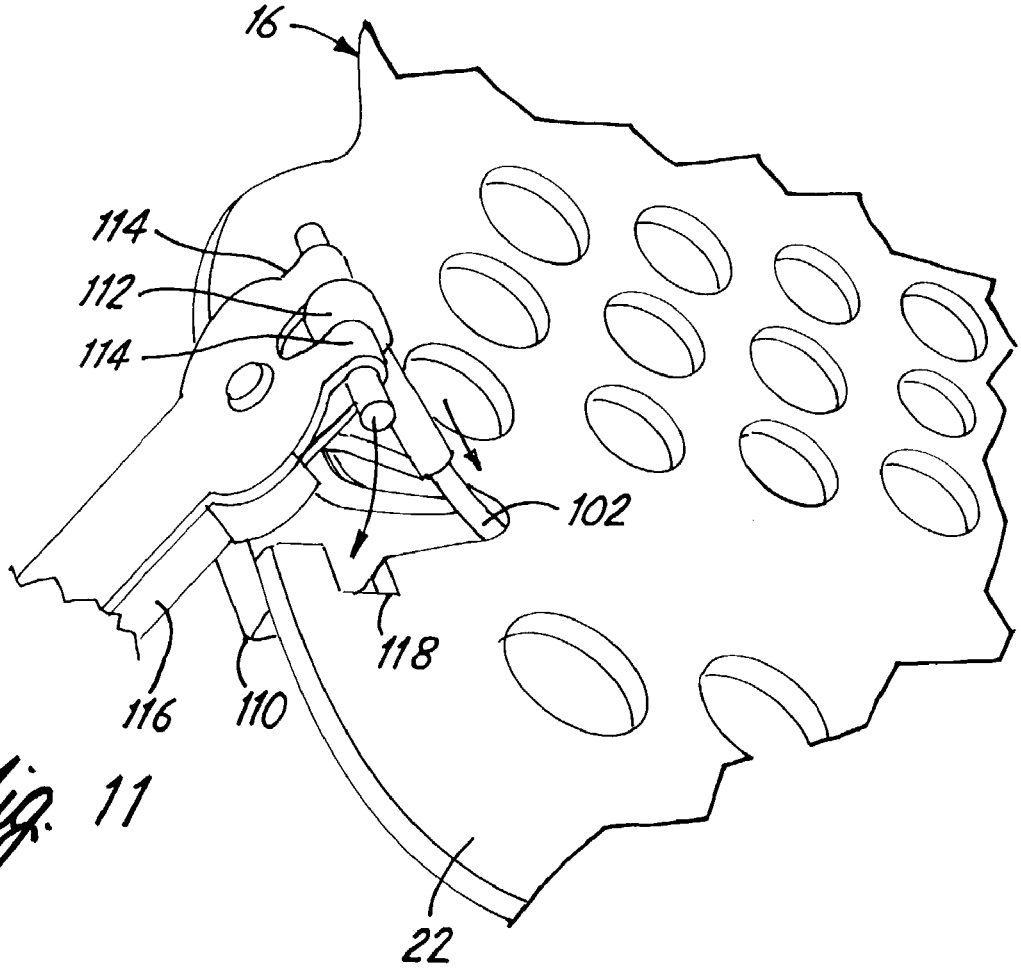
FIG. 11 is a perspective view of a cable assembly of the preferred embodiment of the present invention.

Upon unlatching the tail plate 70 from the rear assembly 14, the tail plate 70 is permitted to rotate about the rear assembly 14. Rotating the tail plate 70 away from the rear assembly 14 permits the cable 102 to become slack because the cable 102 is attached to the tail plate 70. Upon the cable 102 becoming slack, the ferrel 112 can be released from the ferrel guide 118, as illustrated in FIG. 11, which then permits the forward assembly 12 to rotate into the cradle 16. With the forward assembly 12 nestled within the cradle 16, the rear assembly 14 can also be rotated into the cradle 16. Upon the rear wheels 64 engaging the underside of the deck 22, and the tail plate 70 positioned substantially parallel to the deck 22, the skating apparatus 10 is in the folded position, as illustrated in FIG. 2.

To unfold the skating apparatus 10 from the folded position to the skating position, the steps to fold the skating apparatus are simply reversed. First the rear assembly 14, and then the forward assembly 12, are rotated away from the cradle 16 as illustrated in FIG. 3. The forward assembly 12 is rotated until the ferrel 112 nests within a ferrel guide 118 positioned within the deck 22. Upon the ferrel 112 nesting within the ferrel guide 118, the rear assembly 14 is rotated away from the cradle 16 such that the covers 94 approach the underside of the support plates 96 attached to the deck 22. The covers 94 engage the underside of the support plates 96 and the tail plate 70 is positioned such that the latching mechanism 62 latches the tail plate 70, as described, locking the skating apparatus 10 into the unfolded skating position.

Figure 12:
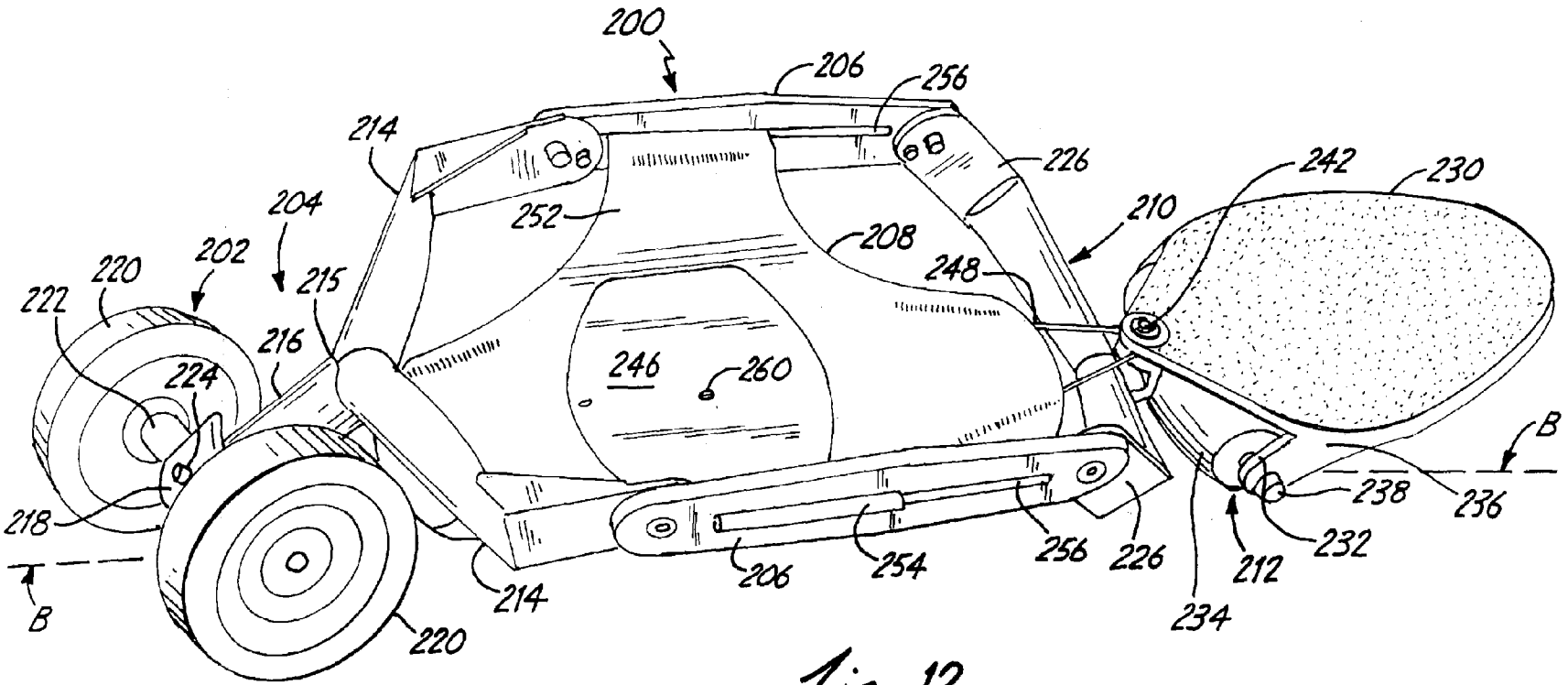
FIG. 12 is a perspective view of a second embodiment of the present invention.
Figure 13:
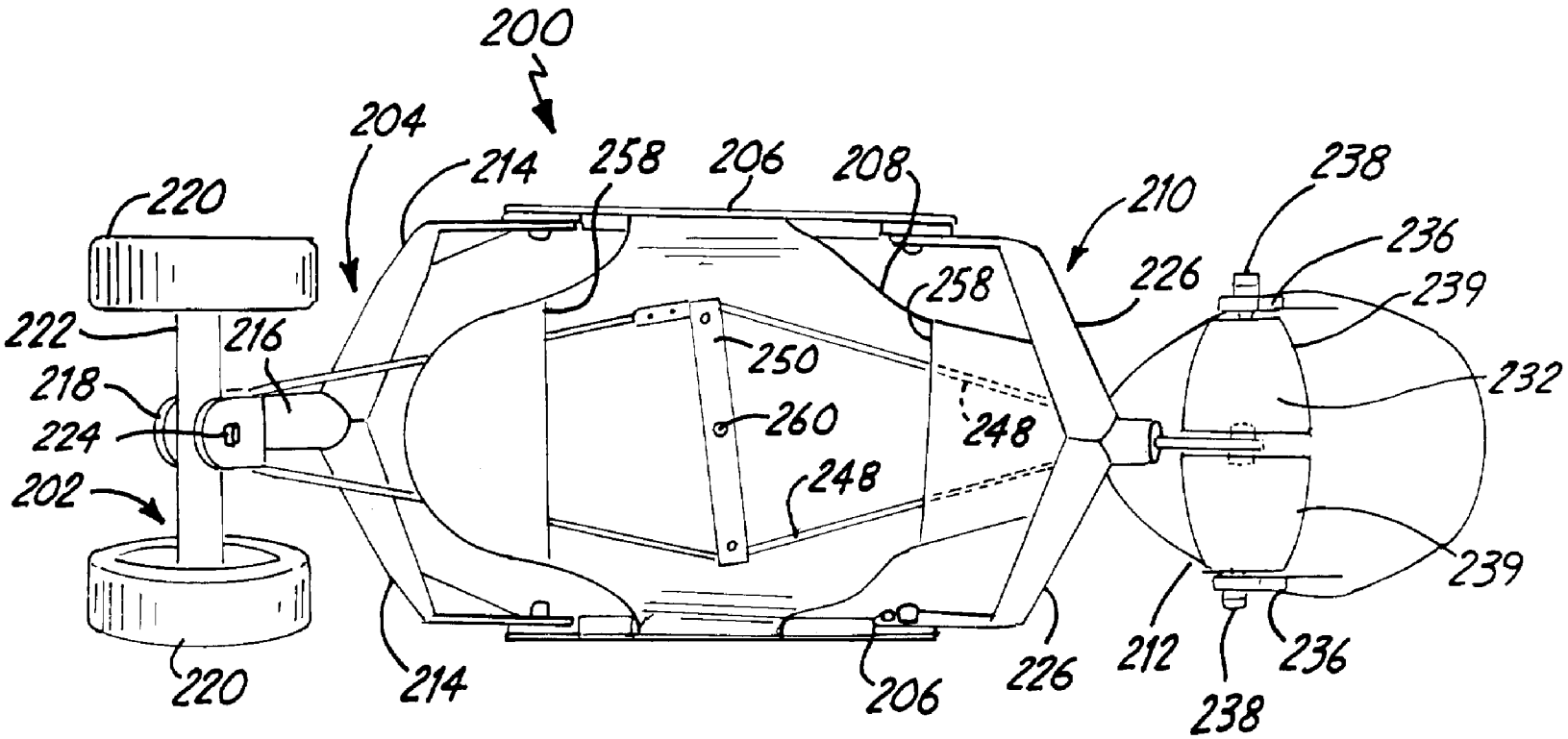
FIG. 13 is a bottom view of the second embodiment of the present invention.

A second embodiment of the present invention is generally indicated at 200 in FIGS. 12 and 13. The second embodiment 200 generally comprises a front wheel assembly 202, a neck assembly 204, cradle arms 206, a deck 208, a tail assembly 210 and a rear wheel assembly 212. The front wheel assembly 202 is attached to the neck assembly 204, while the rear wheel assembly 212 is attached to the tail assembly 210. Both the neck assembly 204 and the tail assembly 210 are pivotally attached to the cradle arms 206 such that the neck assembly 204 and the tail assembly 210 can be folded from a first open position to a second folded position. In the first open position, both the neck assembly 204 and the tail assembly 210 are selectively rotated to a position wherein the front wheel assembly 202 and the rear wheel assembly 212 are capable of engaging the ground. The neck assembly 204 and the tail assembly 210 are prevented from further rotation by stops (not shown) located on the cradle arms 206. In the second folded position, the neck assembly 204 and the tail assembly 210 are rotated in opposite directions such that both nest between the cradle arms 206. While in the folded position, the skating apparatus 200 takes up less volume, and may be carried more easily by the user and also stored more conveniently.

The neck assembly 204 includes neck members 214 and a center arm 216. The neck members 214 pivotally attach to the cradle arms 206, thus allowing the neck assembly 204 to rotate relative to the cradle arms 206. The cradle arms 206 are spaced apart from one another a selected distance which defines the width of the skating apparatus 200. The selected distance between the cradle arms 206 and subsequently the width of the skating apparatus 200 may vary depending upon the size of foot the skating apparatus 200 is designed for. Preferably, the selected distance between the cradle arms 206 will be one which accommodates a range of average foot sizes. Opposing ends of the neck members 214 meet and connect with one another along a longitudinal axis located halfway between the cradle arms 206. The support arm 216 connects to and extends away from the neck members 214 at this juncture 215. Attached to an opposing end of the support arm 216 is a clevis 218 for securing the front wheel assembly 202. The front wheel assembly 202 includes spaced apart, ground engaging wheels 220 connected by and attached to an axle 222. The axle 222 includes a medial aperture (not shown) therethrough for receiving a pin 224, whereby the axle 222 pivotally attaches to the clevis 218 of the center arm 216. Each ground engaging wheel 220 is free to rotate independent of one another, or at differential speeds, which further assists in turning and cornering.

The tail assembly 210 includes connecting tail members 226, a tail arm 228 and a tail platform 230. The tail members 226 are each pivotally attached to the cradle arms 206. Opposing ends of the tail members 226 meet and connect with one another along the longitudinal axis located halfway between the cradle arms 206. The center tail arm 238 attaches to and extends away from the tail members 226 at the junction where the support arms 226 meet. A terminal end of the tail arm 228 includes an aperture (not shown) for receiving a rear axle 232 of the rear wheel assembly 212.

In addition to the rear axle 222, the rear wheel assembly 212 includes ground engaging wheels 220 positioned on the rear axle 222 such that the tail arm 216 disposes between each wheel 220. Each wheel 220 has a frusto-conical configuration having a greater radius at the center and decreasing outwardly. The slant of the rear wheels 220 works in conjunction with the front wheel assembly 202 to assist in maneuverability of the skating apparatus 200.

The tail platform 230 of the tail section 210 includes mount supports 236 extending downwardly from peripheral edges. Each mount support 236 includes an aperture suitable for accepting and inserting threaded terminal ends of the rear axle 232 therethrough. Caps 238 threadably engage each threaded terminal end of the rear axle 232 to pivotally secure the tail platform 230 to the axle 222, which also secures the rear axle to the tail arm 228. A third aperture (not shown) is positioned near a forward end of the tail platform 230. The third aperture of the tail plate 230 is cooperatively alignable with a medial aperture positioned through the tail arm 238. Upon aligning, a threaded bolt 242 or pin may be inserted through each aperture. A threaded cap engages the threaded bolt 242 to fasten the forward end of the tail platform 230 to the tail section 210. The tail platform 230 supports a non-leading foot of the user thereon. Preferably, the tail platform 230 includes a non-skid surface to prevent the non-leading foot from slipping during use.

The deck 208 is preferably constructed of durable fabric. A support platform 246, tension loop 248 and a tension bar 250 are provided to assist in supporting the weight of the user. The deck 208 may be constructed to include a major axis and a minor axis. Along the minor axis protrudes wings 252 of material. Each wing 252 is folded over itself and sewn so as to form a cylindrical channel 254. Each wing 252 is insertable through an elongated slot 256 contained in the respective cradle arm 206. Upon inserting the cylindrical channel of each wing 252 through the respective slot 256, a rod (not shown) having a diameter greater than the width of each slot 256 is inserted through each channel 254, thus preventing the wings 252 from being removed from the slots 256.

Along the major axis of the deck 208 runs the tension loop 248. The tension loop 248 preferably comprises a continuous loop of wire cable having a selected length. However, it would also be within the scope of the present invention to include two separate tension wires instead of a continuous loop. The tension loop 248 nests within the clevis 218 and is securably positioned by the threaded bolt 242 which also secures the tail plate 230. As illustrated in FIG. 12, the tension loop 248 runs along an under side of the deck 208. The deck 208 may have channel flaps 258 sewn along the perimeter, similar to those used to attach the fabric within the slots 256 of the cradle arm 206 which house each wire of the tension loop 248. By positioning the tension loop 248 at these points, the deck portion lies substantially in a plane B—B which includes the axles 222 and 232 of the front and rear wheel assemblies 202 and 212, respectively. This provides the advantage of having a low center of gravity which aides in stabilizing and maneuvering the skating apparatus 200 during use.

The rigid deck platform 246 is positioned upon the durable fabric of the deck 208. The deck platform 246 provides an area for the user to place a leading foot while using the skating apparatus 200. The deck platform 246 attaches to the fabric 208 by means of a fastener 260. The fastener 260 inserts through an aperture in the fabric. Additionally, the fastener 260 also rotatably secures the tension bar 250 to the underside of the deck 208. An aperture in the tension bar permits the fastener to be inserted therethrough. By rotating the tension bar 250, the tension loop 248 can be brought under tension or relaxed.

The tension loop 248 has a fixed selected length and is secured to the neck assembly 204 and the tail assembly 210 as described. Preferably, the selected length of the tension loop 248 depends upon the length between the attaching points on both the neck assembly 204 and the tail assembly 210 while the skating apparatus 200 is in the first open position. This selected length permits the tension loop 248 to be somewhat slack in a natural state, for example, when the tension bar 250 is not acting upon the tension loop 248. When the tension bar 250 is positioned along the major axis of the skating apparatus 200, the tension bar 250 does not come into contact with the tension loop 248, and the tension loop 248 is in the relaxed state. When the tension bar 250 is positioned along the minor axis of the skating apparatus 200, the tension bar 250 comes into contact with both cables of the tension loop 248, and urges the cables apart from one another, as illustrated in FIG. 13, placing the tension loop 248 under tension. By placing the tension loop 248 under tension, the skating apparatus 200 as a whole becomes more rigid since the neck assembly 204 and the tail assembly 210 are prevented from traveling past the first open position. Also, while under tension, the tension loop 248 provides stability to the deck platform 246 which the tension loop 248 assists in supporting.

As described, folding and unfolding of the skating apparatus 200 is accomplished by rotating the neck assembly 204 and the tail assembly 210 in relation to one another and the cradle arms 206. To fold the skating apparatus 200 from the first open position to the second folded position, the threaded bolt 242 is unfastened, thus unfastening the tail plate 230 and tension loop 248 from the tail arm 228. The neck assembly 204 is rotated into the cradle 206 such that the front wheel assembly 202 is positioned proximate the deck 208. The tail assembly 210 is rotated into the cradle 206 such that the tail assembly 210 is positioned proximate the neck assembly 204 and the deck 208. The tail plate 230 is then positioned substantially parallel to the deck 208. Upon rotating the neck assembly 204, the tail assembly 210 and the tail plate 230 as described, the skating apparatus 200 is in the second folded position. It should be noted, however, that it is within the scope of the present invention to modify the design of either the neck assembly 204 or the tail assembly 210 so as to rotate either assembly ahead of the other to place the skating apparatus 200 into the folded position. To unfold the skating apparatus 200, the process as just described is reversed. When the skating apparatus 200 is in the unfolded skating position, the front axle 222, the rear axle 232 and the deck 208 are all positioned substantially within the plane B—B, as illustrated in FIG. 12.

Figure 14:
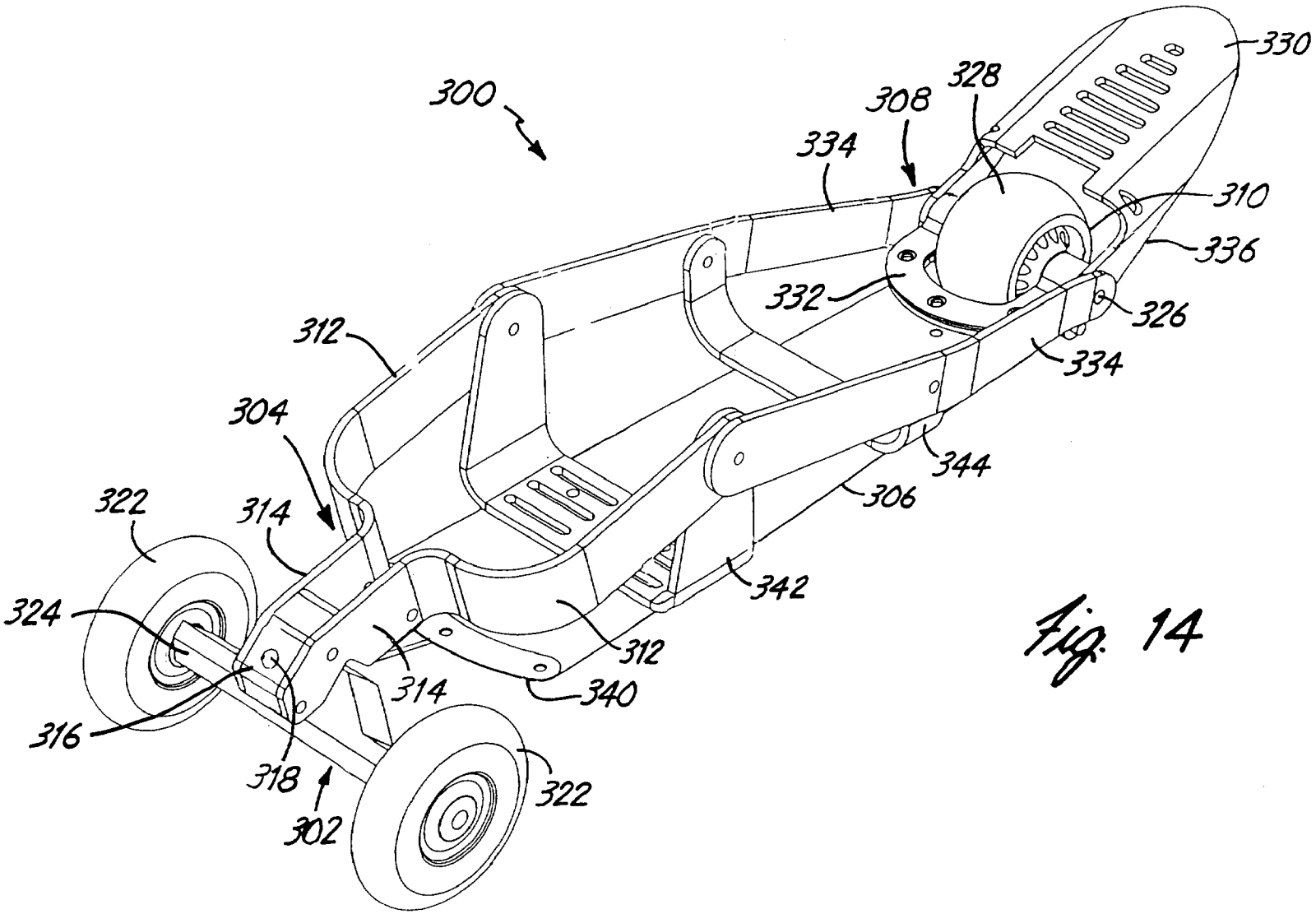
FIG. 14 is a perspective view of a third embodiment of the present invention.
Figure 15:
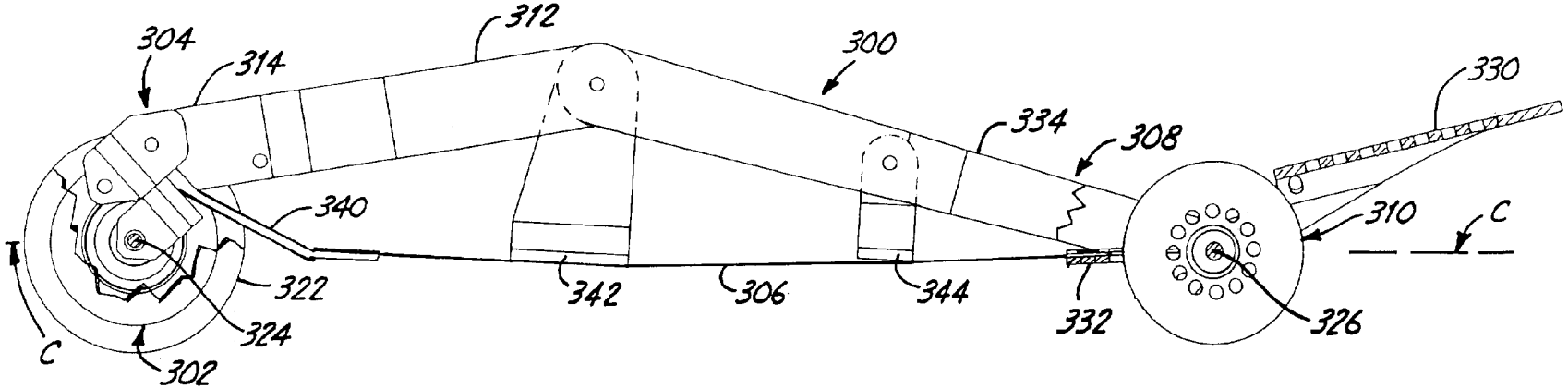
FIG. 15 is a side view of the third embodiment of the present invention.

A third embodiment of the articulated skating apparatus according to the present invention is generally indicated at 300 in FIGS. 14 and 15. The articulated skating apparatus comprises a front wheel assembly 302, a neck assembly 304, a deck 306, a tail assembly 308 and a rear wheel assembly 310. The front wheel assembly 302 is attached to the neck assembly 304, while the rear wheel assembly 310 is attached to the tail assembly 308. The neck assembly and the tail assembly can be folded from a first open position to a second folded position. In the first open position, both the neck assembly 304 and the tail assembly 308 are selectively rotated to a riding position wherein the front wheel assembly 302 and the rear wheel assembly 310 are capable of engaging the ground. The neck assembly 304 and the tail assembly 308 are each prevented from being further rotated past the riding position. In the second folded position, the neck assembly 304 and the tail assembly 308 are rotated inwardly into the folded position. While in the folded position, the skating apparatus 300 takes up less volume, and may be carried more easily by the user and also stored more conveniently.

The neck assembly 304 includes neck members 312 connected to nose members 314. Disposed between and attached to the nose members 314 is a nose core 316 which contains an aperture 318 for positioning a retaining bolt (not shown) therethrough. The retaining bolt (not shown) secures the front wheel assembly 302 to the neck assembly 304. The front wheel assembly 302 includes ground engaging wheels 322 connected by and attached to terminal ends of a front chassis member 324. The front chassis member 324 includes an aperture (not shown) therethrough for receiving the retaining bolt to secure the front wheel assembly 302 to the neck assembly 304. The front chassis 324 is pivotally secured to the neck assembly 304 which allows the front wheel assembly 302 to be rotatable with respect to the neck assembly 304. Additionally, each ground engaging wheel 322 may rotate independent of one an-other, or at differential speeds, which further assists in turning and cornering.

The rear wheel assembly 310 includes an axle 326, a ground engaging wheel 328, a tail plate 330 and a rear deck attachment 332. The wheel 328 is medially positioned on the axle 326. Tail arms 334 of the rear deck attachment 332 are positioned on the axle 326 proximate to opposing sides of the wheel 328. Positioned proximate the rear deck attachment 332 are downwardly extending members 336 of the tail plate 330. The wheel 328, rear deck attachment 332 and the tail plate 330 are all rotatable about the axle 326. Positioned on opposing terminal ends of the axle 326 are the tail arms 334. Each tail arm 334 secures to the respective opposing terminal ends of the axle 326, thus securing the wheel 328, rear deck attachment 332 and the tail plate 330 to the axle 326. Opposing ends of the tail arms 334 rotatably attach to the respective neck arms 334.

The deck 306 is preferably constructed of flexible material, and is attached to the neck assembly 302 by means of a front deck attachment 340, and is attached to the tail assembly by means of the rear deck attachment 332. A forward deck support 342 and a rearward deck support 344 are included to assist in supporting the weight of the user. Attachment of the flexible deck 306 to the front deck attachment 340 and the rear deck attachment 332 may be accomplished by any suitable means including, but not limited to, rivets, bolts, screws or adhesion. The front deck attachment 340 is pivotally anchored to the neck assembly 304. The front deck attachment 340 is also pivotally secured to the neck portion 304 and the rear deck attachment 332 is pivotally secured to the rear wheel assembly 310, thus allowing the deck 306 to flex more easily upon folding the skating apparatus 300. Rotatably mounting the front and rear deck attachments 340 and 332 also enhances conformity when placing a foot of the user thereon.

Preferably, the forward deck support 342 is pivotally attached at the juncture where the neck arms 312 pivotally attach to the tail arms 334, and the rearward deck support 344 is pivotally attached to the tail arms 334 proximate the rear wheel assembly 310. However, the position of either deck support 342 or 344 may be repositioned and still be within the scope of the present invention. Both deck supports 342 and 344 are pivotally attached such that they collapse upon folding the skating apparatus 300. When the skating apparatus 300 is in the unfolded skating position, the chassis member 324, the rear axle 326 and the deck 308 are all positioned substantially within plane C—C, as illustrated in FIG. 15.

Figure 16:
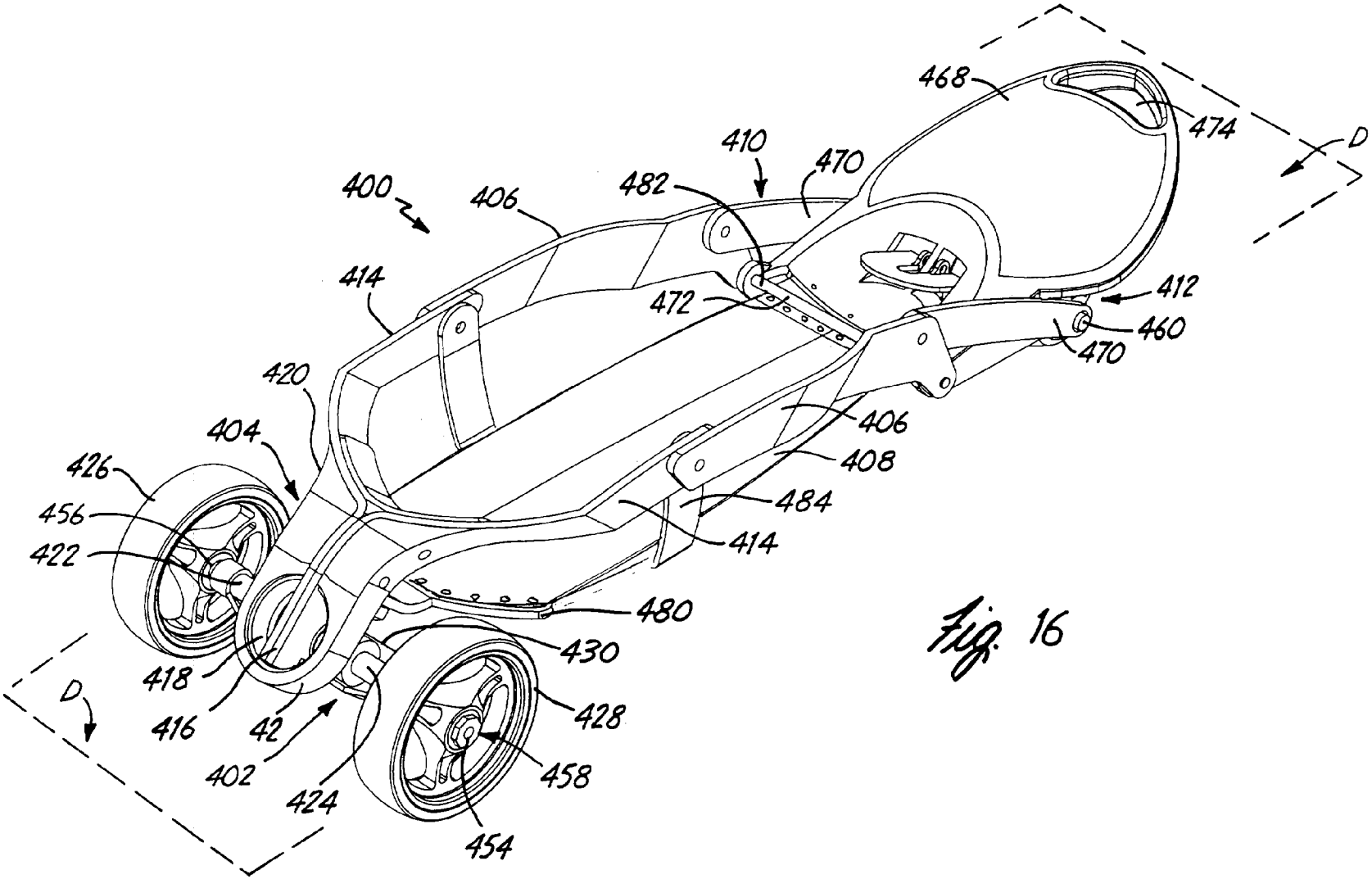
FIG. 16 is a perspective view of a fourth embodiment of the present invention.
Figure 17:
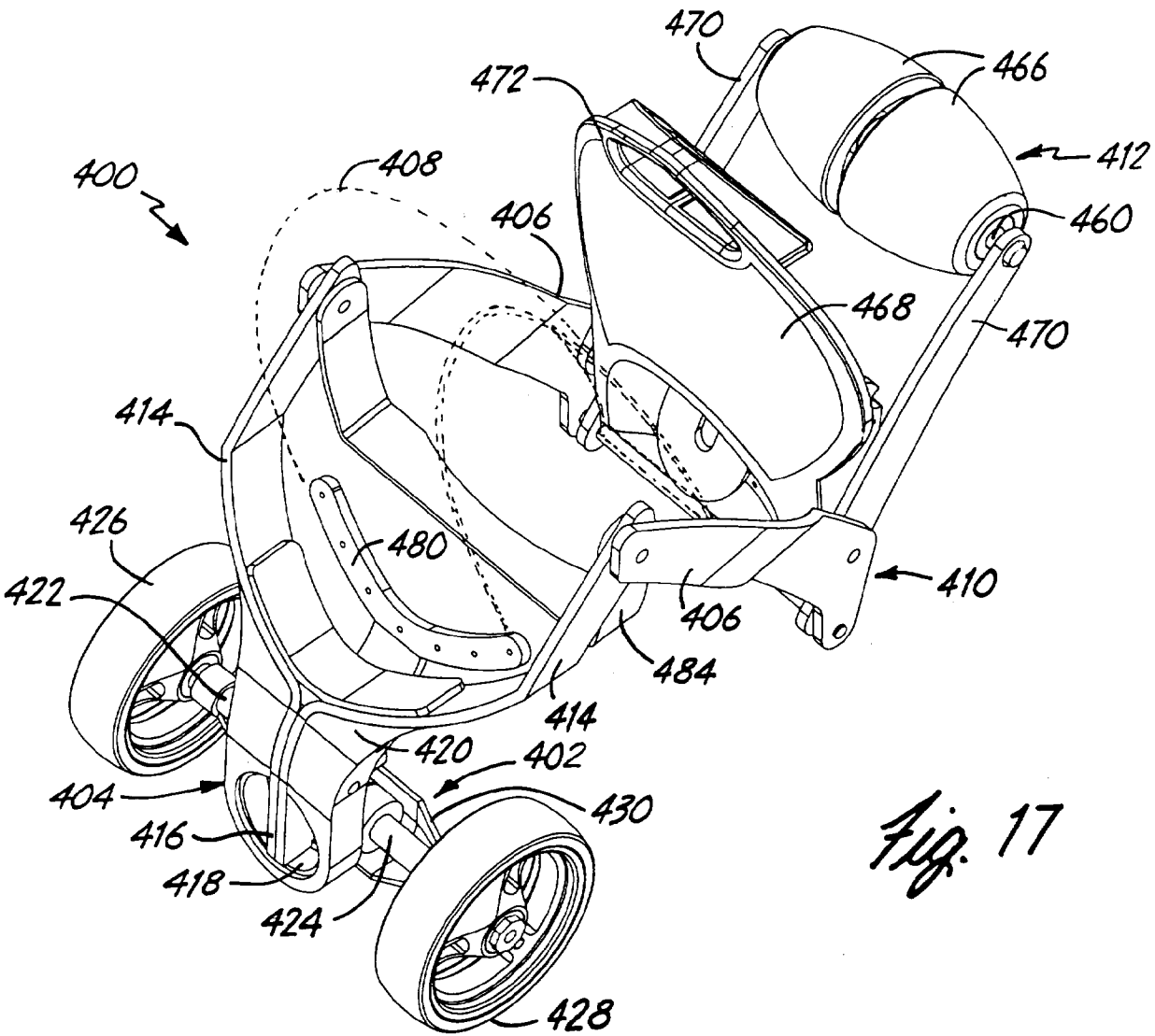
FIG. 17 is a perspective view of the fourth embodiment of the present invention being positioned between a first unfolded position and a second folded position.
Figure 18:
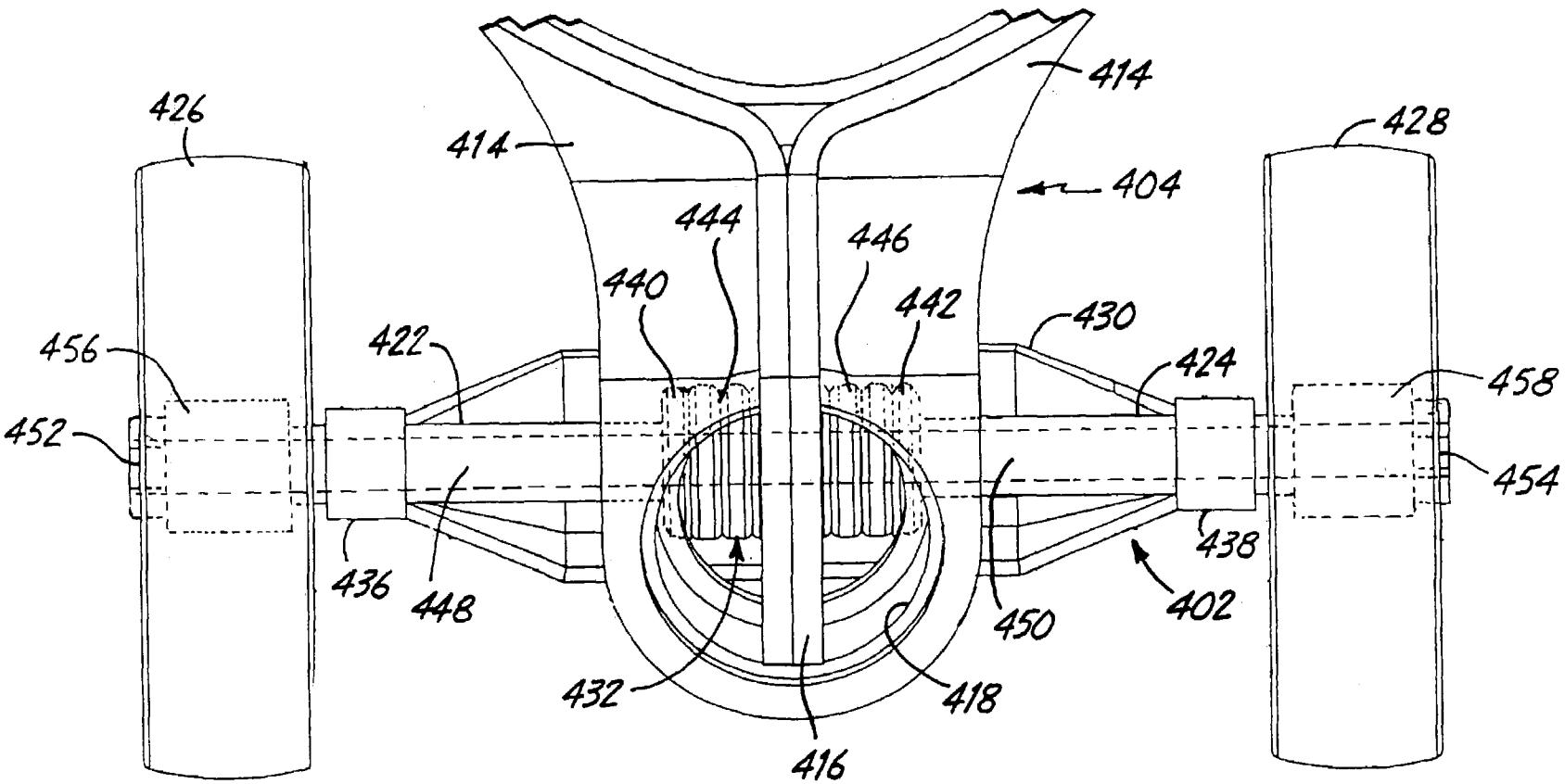
FIG. 18 is a top view of a dampening mechanism of the fourth embodiment of the present invention.

A fourth embodiment of the articulated skating apparatus of the present invention is generally indicated at 400 in FIGS. 16–18. The articulated skating apparatus 400 generally comprises a front wheel assembly 402, a neck assembly 404, cradle members 406, a deck portion 408, a tail assembly 410 and a rear wheel assembly 412. The front wheel assembly 402 is attached to the neck assembly 404, while the rear wheel assembly 412 is attached to the tail assembly 410. Both the neck assembly 404 and the tail assembly 410 are pivotally attached to the cradle members 406 such that the neck assembly 404 and the tail assembly 404 can be folded from a first skating position to a second folded position. In the first open position, both the neck assembly 404 and the tail assembly 410 are selectively rotated to a position wherein the front and rear wheel assemblies, 402 and 412, are capable of engaging the ground. The neck and tail assemblies, 404 and 410, are prevented from being further rotated past this selected position. In the second folded position, the neck assembly 404 and the tail assembly 410 are both rotated in the same direction relative to one another such that each assembly, 404 and 410, is disposed between the cradle members 406, as illustrated in FIG. 17. While in the folded position, the skating apparatus 400 takes up less volume, and may be carried more easily by the user and also stored more conveniently.

The neck assembly 404 includes neck members 414 which eventually meet to form a neck support arm 416. The neck members 414 are each pivotally attached to the respective cradle members 406. Each neck member 414 initially has an approximate quarter-circular shape but, upon meeting and engaging one another, each arm 414 straightens and continues on a downward slant, forming the structure of the neck arm 416. Positioned about the neck is a circular member 418 and support braces 420. The circular outer member 418 assists in supporting the front wheel assembly 402.

As illustrated in FIG. 18, the front wheel assembly 402 includes first and second axles, 422 and 424 respectively, ground engaging wheels 426 and 428 attached to distal ends of the respective axles 422 and 424, an undercarriage truss 430, and a dampening system 432. The undercarriage truss 430 includes a substantially semi-circular shaped body connected to the neck arm 416 and each axle 422 and 424. The undercarriage truss 430 attaches to the axles 422 and 424 by way of collars 436 and 438 positioned proximate each wheel 426 and 428. Each axle 422 and 424 includes a circular bushing 440 and 442 attached thereto. Each bushing 440 and 442 engages the circular outer member 418 surrounding the center support arm 416, allowing the front wheel assembly 402 to rotate about the circular member 418, which assists in turning or cornering the skating apparatus 400. Additionally, each ground engaging wheel 426 and 428 is free to rotate independent of one another, or at differential speeds, which further assists in turning and cornering the skating apparatus 400. The ease at which the front wheel assembly 402 rotates about the circular outer member 418 may be modified by the dampening system 132.

The dampening system 432 includes compressible washers 444 and 446 positioned between proximal ends of the bushings 440 and 442 and the neck support 416. The axles 422 and 424 each contain a cylindrical channel therethrough for receiving and accepting extensible shafts 448 and 450. The extensible shafts 448 and 450 engage the compressible washers 444 and 446, respectively, which engage the neck arm 416. The extensible shafts 448 and 450 may be lengthened or shortened by set screws 452 and 454 located within a hub 456 and 458 of each wheel 426 and 428. Extending the shafts 448 and 450 compresses the washers 444 and 446 against the neck arm 416, Which in turn decreases the ease at which the front wheel assembly 402 may be rotated. To increase the ease at which the front wheel assembly 402 may be rotated, the extensible shafts 448 and 450 are drawn away from the washers 444 and 446, which in turn does not provide as great a force upon the neck support arm 416.

Referring back to FIG. 17, the rear wheel assembly 412 includes an axle 460, outer spacers (not shown), a center spacer (not shown) and ground engaging wheels 466. The wheels 466 are positioned on the axle 460 such that the center spacer (not shown) is positioned therebetween. The outer spacers are each positioned on terminal ends of the axle 460. Each wheel 466 has a frusto-conical configuration having a greater radius at the center and decreasing outwardly. The slant of the rear wheels 466 works in conjunction with the front wheel assembly 402 to assist in maneuverability of the skating apparatus 400.

The tail assembly 410 includes a tail plate 468 and axle arms 470. The support arms 470 each include an aperture therethrough for receiving a bolt to pivotally attach the rear wheel assembly 412 to the cradle arms 406. The axle arms 470 are positioned such that the outer spacers are positioned between the respective axle arms 470 and the respective wheels 466. The tail plate pivotally attaches to the cradle members 406 by securing pin 472. Additionally, the tail plate includes a center downwardly extending member (not shown) positionable between the ground engaging wheels 466 whereupon the downwardly extending member rests upon the center spacer positioned between the wheels 466. The tail platform 468 supports a non-leading foot of the user thereon. The tail platform 468 may by coated with a non-skid surface to prevent the non-leading foot from slipping during use. A rear portion of the tail platform may also include a handle 474 for which the user can grab to carry the skating apparatus 400, whether the skating apparatus 400 be in the first open position or the second folded position.

The deck portion 408 includes a flexible deck 478, a front deck attachment 480, a rear deck attachment 482 and a deck support brace 484. Opposing ends of the flexible deck 403 attach to the front and rear deck attachments 480 and 482. Attachment of the flexible deck 470 to the front deck attachment 480 or the rear deck attachment 482 may be accomplished by any suitable means including, but not limited to, rivets, bolts, screws or adhesion. The front deck attachment 480 pivotally anchors to the neck 404 while the rear deck attachment 482 pivotally secures to the cradle members 406, preferably on the same pin 472 which attaches the tail plate 468 to the cradle members 406. Both the front deck attachment 480 and the rear deck attachment 482 are pivotally mounted to the neck portion 404 and the tail portion 410 such that the deck 478 flexes more easily upon folding the skating apparatus 400. Pivotally mounting the front and rear deck attachments 480 and 482 also enhances conformity of the flexible deck 478 when placing a leading foot upon the deck.

The deck support brace 484 is positioned towards the forward end of the skating apparatus 400, preferably more proximate the neck assembly 404 as opposed to the tail assembly 410. However, the position of the deck support brace 484 can be positioned either way and still be within the scope of the present invention. Preferably, the deck support brace 484 pivotally attaches to the cradle members 406. The deck support brace 484 is such that it collapses between the cradle members 406 upon folding the skating apparatus 400 as illustrated in FIG. 17. When the skating apparatus 400 is in the unfolded skating position, the front axles 422 and 424, the rear axle 460 and the deck 408 are all positioned substantially within plane D, as illustrated in FIG. 16.

Figure 19:
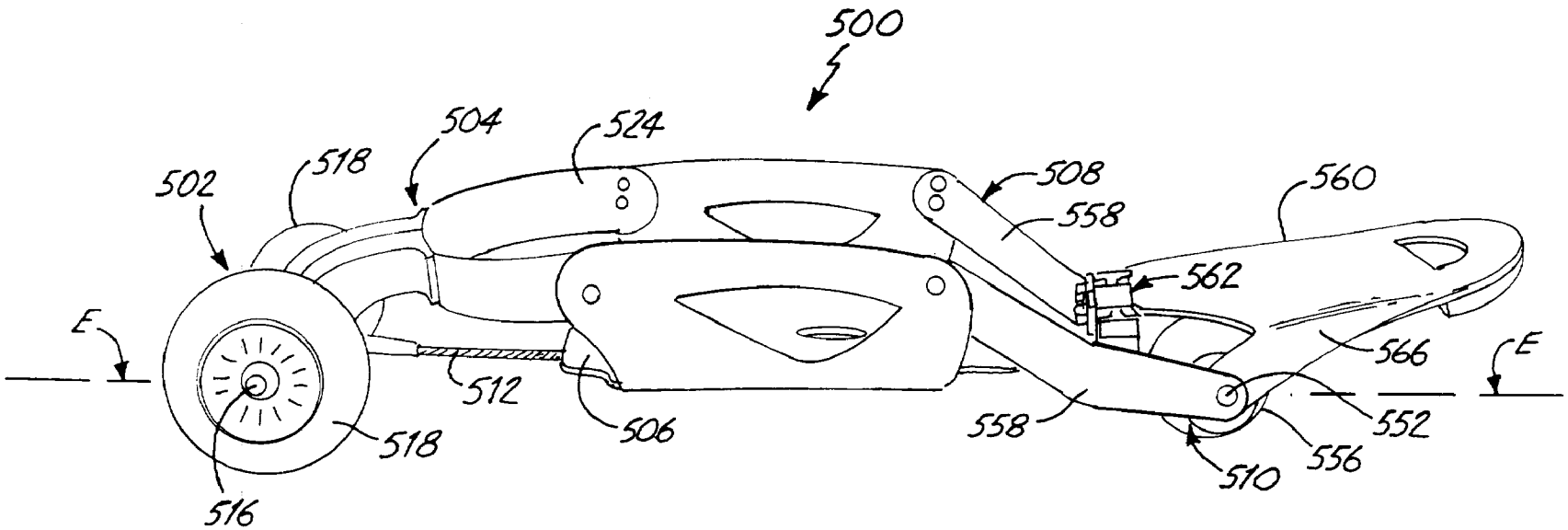
FIG. 19 is a side perspective view of a fifth embodiment of the present invention.
Figure 20:
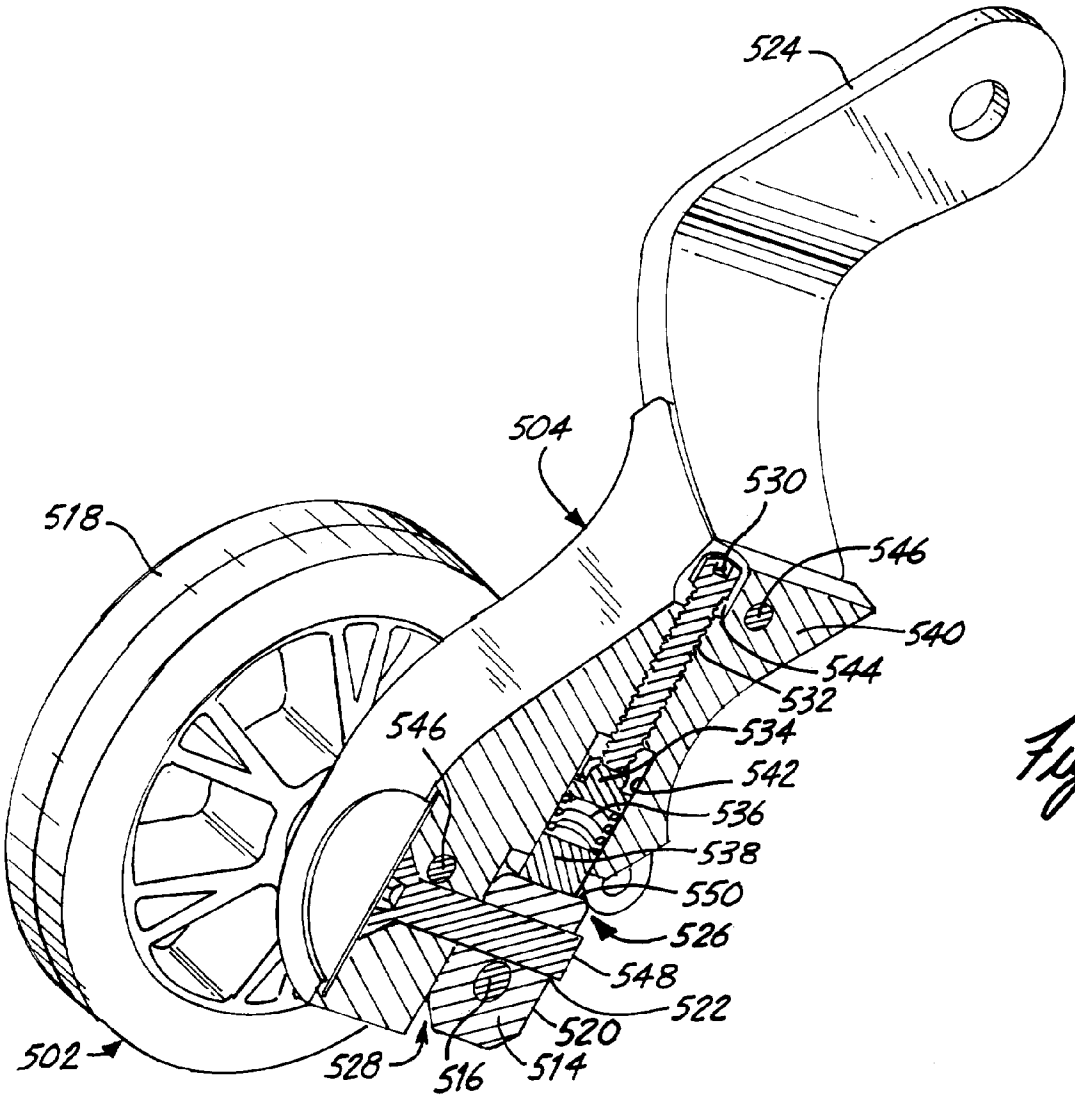
FIG. 20 is a cutaway view illustrating a dampening mechanism of the fifth embodiment of the present invention.
Figure 21:
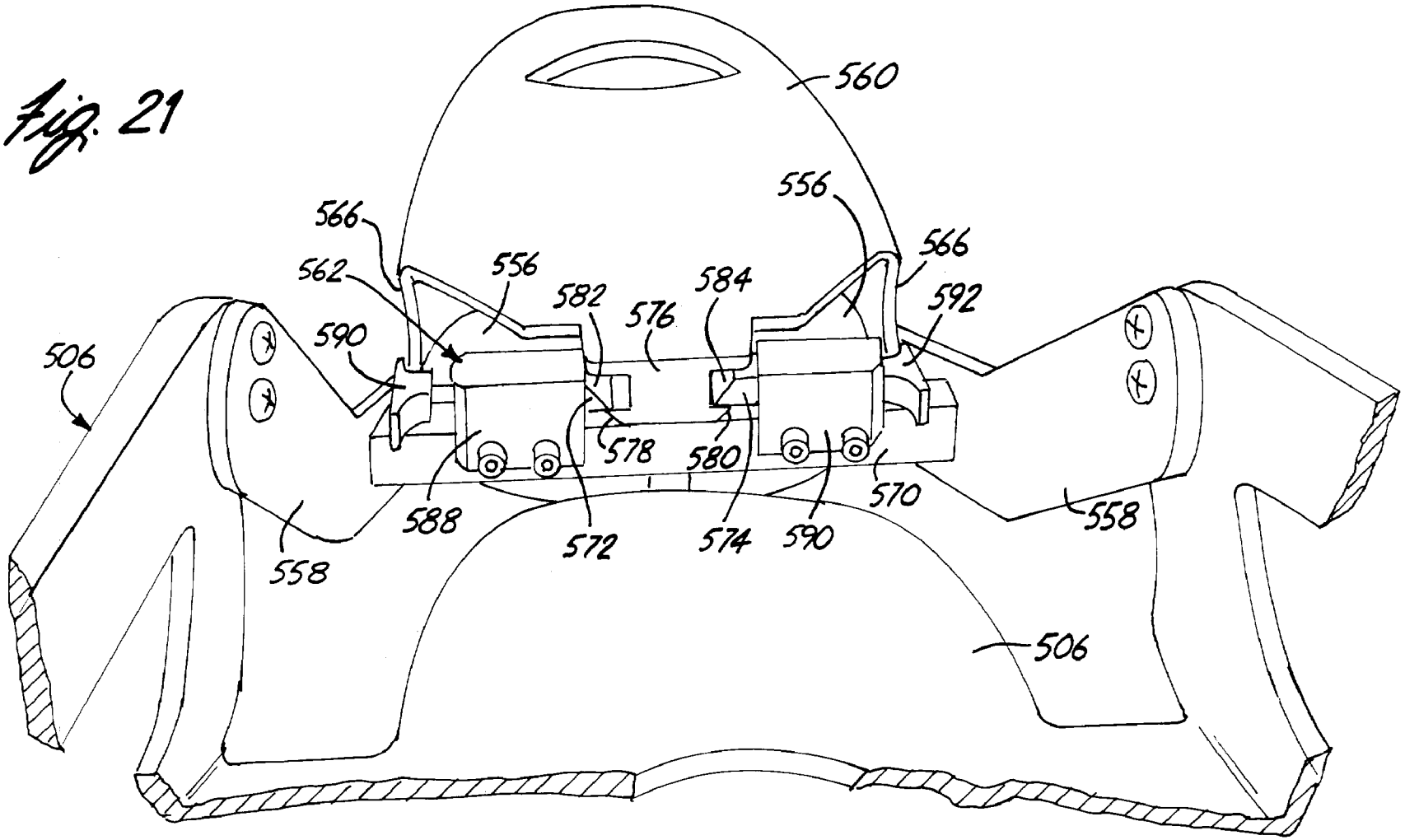
FIG. 21 is a cutaway view of a locking mechanism and tail assembly of the fifth embodiment of the present invention.

A fifth embodiment of the articulated skating apparatus according to the present invention is generally indicated at 500 in FIGS. 19–21. The articulated skating apparatus 500 generally comprises a front wheel assembly 502, a neck assembly 504, a cradle 506, a tail assembly 508, a rear wheel assembly 510 and a tension cable 512. The front wheel assembly 502 attaches to the neck assembly 504, while the rear wheel assembly 510 attaches to the tail assembly 508. Both the neck assembly 504 and the tail assembly 508 are pivotally attached to the cradle 506 and can be folded from a first open position to a second folded position. In the first open position, both the neck assembly 504 and the tail assembly 508 are selectively rotated to a position wherein the front wheel assembly 502 and the rear wheel assembly 510 are capable of engaging the ground. The neck assembly 504 and the tail assembly 508 are prevented from being further rotated past the first open position. In the second folded position, the neck assembly 504 and the tail assembly 508 are rotated in opposite directions relative to one another such that both nest within the cradle 506. While in the folded position, the skating apparatus 500 takes up less volume, and may be carried more easily by the user and also stored more conveniently.

As illustrated in FIG. 20, the front wheel assembly 502 includes a solid body core 514, an axle 516 positionable within the solid body core 514, ground engaging wheels 518 rotatably attached to opposing ends of the axle 516, and a housing 520 to contain the solid body core 514 and the axle 516. The housing 520 and the solid body core 514 each include a medial aperture 522 therethrough, positioned transverse to the axle 516, for receiving an attachment means to pivotally secure the front wheel assembly 502 to the neck portion 504 to assist in turning or maneuvering the skating apparatus 500. Additionally, each ground engaging wheel 518 is independently rotatable, which further assists in turning and maneuvering.

The neck assembly 504 includes neck members 524 and a steering dampening assembly 526. The neck members 524 are each pivotally attached to the cradle 506. Opposing ends of the neck members 524 each include a rectangular notch 528 to receive the housing 520 of the front wheel assembly 502. Spaced between the opposing ends of the neck members 524 is the steering dampening assembly 526. The steering dampening assembly 526 comprises a control bolt 530, mateable sleeve 532, a pusher 534, a compressible spring 536 and a positionable block 538, all encased within a neck core 540. The neck core 540 contains a first rectangular cavity 542 which houses the positionable block 538, compressible spring 536 and pusher 534. The neck core 540 also contains a second circular cavity 544 which seats the mateable sleeve 532. The neck core 540 secures to the neck members 524 by means of bolt attachments 546. The front wheel assembly 502 is attached to the neck assembly 504 by a center pin 548 inserted through the neck core 540 and the medial apertures 522 of the housing 520 and solid body core 514.

The front wheel assembly 502 pivots about the bolt 548 inserted through the medial apertures 522. As discussed, pivoting the front wheel assembly 502 assists in cornering and maneuvering the skating apparatus 500. However, depending on the type of use the skating apparatus 500 is to be put through, it may be desirable to modify the amount of force needed to pivot the front wheel assembly 502. The steering dampening assembly 526 is designed to selectively control the ease at which the front wheel assembly 502 can be rotated with respect to the neck 504. The front wheel assembly 502 is allowed to pivot about the central pin 548. The positionable block 538 of the dampening assembly 526 abuts a top surface 550 of the housing 520. The positionable block 538 is urged against the housing 520 by the compressible spring 536, which is disposed between the positionable block 538 and the pusher 534. In a like manner, the spring 536 urges the pusher 534 against the control bolt 530 which threadably engages the mateable sleeve 532. Upon pivoting the front wheel assembly 502 in either direction, the positionable block 538 is urged deeper within the rectangular cavity 542 against the force of the compressible spring 536. The more the front wheel assembly 502 is rotated, the greater the force the compressible spring 536 exerts onto the positionable block 538 and subsequently onto the housing 520 of the front wheel assembly 502. To selectively modify this force, the depth of the control bolt 530 is either increased or decreased. The depth of the control bolt 530 is increased by rotating the control bolt 530 in a clockwise direction, while the depth is decreased by rotating the control bolt 530 in the counter-clockwise direction. It should be understood, though, that this depends upon the threading of the mateable sleeve 532, and reversing the directions by which to increase or decrease the control bolt 530 depth is well within the scope of the present invention. Increasing the depth of the control bolt 530 urges the pusher 534 deeper within the rectangular cavity 542, which compresses the spring 536, resulting in a greater force upon the positionable block 538, which decreases the ease at which the front wheel assembly 502 pivots. By decreasing the depth of the bolt 530, the compressible spring 536 urges the pusher 534 away, resulting in a lesser force upon the positionable block 538, which increases the ease at which the front wheel assembly 502 pivots.

The rear wheel assembly 510 includes an axle 552, a center spacer (not shown) and ground engaging wheels 556. The wheels 556 are positioned on the axle 552 such that the center spacer (not shown) is positioned between each wheel 556. Each wheel 556 has a frusto-conical configuration having a greater radius at the center and decreasing outwardly. The slant of the rear wheels 556 works in conjunction with the front wheel assembly 502 to assist in the maneuverability of the skating apparatus 500. When the skating apparatus 500 is in the unfolded skating position, the front axle 516, the rear axle 552 and the cradle 506 are all positioned substantially within plane E—E, as illustrated in FIG. 19.

The tail assembly 508 includes tail arms 558, a tail platform 560 and a locking mechanism 562. The tail arms 558 are each pivotally attached to the cradle 506. Opposing ends of the tail arms 558 each include an aperture therethrough for receiving the rear axle 552. The tail platform 560 includes mount supports 566 extending downwardly from peripheral edges. Each mount support 566 pivotally attaches to terminal ends of the rear axle 552. Each mount support 566 is positioned between the respective wheel 556 and tail arm 558. Caps (not shown) threadably engage each terminal end of the axle 552 to secure the tail platform 560 and the tail arms 558 thereto.

The locking mechanism 562 works in conjunction with the tension cable 572 to lock and provide rigidity to the skating apparatus 500 while in the first open position. The tension cable 512 removably attaches to the neck portion 504 and the tail assembly 508, whereupon locking the tail platform 560 in position, the tension cable 514 becomes taut. As best illustrated in FIG. 21, the locking mechanism 562 includes a crossbar 570 attached to the tail arms 558, first and second movable latch bolts 572 and 574 positioned on the crossbar 570, and a locking member 576 fixedly attached to the tail plate 560. The locking member 576 includes ledges 578 and 580, each positioned on opposing sides, which are aligned to engage the latch bolts 572 and 574 respectively. To lock the mechanism 562, the tail plate 560 is rotated to bring each ledge 578 and 580 of the locking member 576 into contact with respective latching bolts 572 and 574. Each bolt 572 and 574 contains an inclined surface 582 and 584, whereupon each ledge 578 and 580 contacts the respective inclined surface 582 and 584, each latching bolt 572 and 574 is urged away from the locking member 576 and into a latching housing 588 and 590, which contains a spring (not shown) urging the latch bolts 572 and 574 against the locking member 576. Upon positioning the ledges 578 and 580 of the locking member 576 past the latch bolts 572 and 574, the internal springs urge the latch bolts 572 and 574 outward, and the tail plate 560 locks into position. To release the tail plate 560, each latch bolt 572 and 574 is urged away from the respective ledges 578 and 580 of the locking member 576 by pulling on a handle 590 and 592 attached to each respective latch bolt 572 and 574.

Although the present invention has been described with reference to preferred embodiments, workers skilled in the art will recognize that changes may be made in form and detail without departing from the spirit and scope of the invention. Workers skilled in the art will further recognize that interchanging certain elements of one embodiment with elements of another embodiment are well within the scope of the present invention.

The invention claimed is:

1. A skateboard comprising:

an articulated foldable structure, the articulated structure including a foot platform defining a longitudinal plane and having a forward portion and a rearward portion;

at least one forward ground engaging wheel operably connected to the articulated structure, the at least one forward ground engaging wheel having a first rotational axis; and at least one rearward ground engaging wheel operably connected to the articulated structure, the at least one rearward ground engaging wheel having a second rotational axis;

wherein the first rotational axis and the second rotational axis and lie substantially in the longitudinal plane of the foot platform, and a tensioning mechanism including a cable attached at one end to the forward portion and attached at another end to the rearward portion for placing the articulated structure under tension while in a first skating position, wherein the forward portion and the rearward portion are each positionable from the first skating position to a second folded position with the cable becoming slack and wherein the forward portion and the rearward portion each nest within the middle portion while in the second folded position.

2. The skateboard of claim 1 wherein the at least one forward ground engaging wheel and the at least one rearward ground engaging wheel are movable about the articulated structure to a folded position.

3. The skateboard of claim 2 and further comprising a brake to engage the at least one rearward wheel and/or the ground to apply a braking force.

4. The skateboard of claim 1 and further comprising:

a forward portion, the at least one forward ground engaging wheel attached thereto;

a rearward portion, the at least one rearward ground engaging wheel attached thereto; and a middle portion including the foot platform;

wherein the forward portion and the rearward portion pivotally connect to the middle portion.

5. The skateboard of claim 1 wherein the articulated structure is foldable in a direction opposite the tensioning forces.

6. The skateboard of claim 1 and further comprising an adjustable dampening mechanism for varying the ease of steering the skateboard.

7. The skateboard of claim 6 wherein the dampening mechanism comprises:

an adjustable member;

a first moveable member engaging the adjustable member;

a spring engaging the first moveable member;

a second moveable member, the spring disposed between the first moveable member and the second moveable member;

an axial member, the second moveable member engaging the axial member; and a pin, the axial member pivotable about the pin;

wherein the adjustable member urges the first moveable member against the spring, the spring urging the second member against the axial member varying the ease at which the axial member pivots about the pin.

8. The skateboard of claim 7 wherein the force exerted by the spring may be varied by increasing or decreasing the length of the adjustable member.

9. The skateboard of claim 6 wherein the dampening mechanism comprises:

an axial member attached to the at least one ground engaging wheel;

an extensible member disposed within the axial member; and a compressible member, the extensible member engaging the compressible member;

wherein varying the length of the extensible member varies the ease of steering the at least one ground engaging wheel.

10. A skateboard comprising:

a first portion including at least one ground engaging wheel;

a second portion including at least one ground engaging wheel;

a third portion disposed between the first and second portions, the first portion and the second portion connected to the third portion wherein the first portion and the second portion are positionable towards each other such that the first and second portions nest within the third portion when the skateboard is in a folded position; and a cable in tension and attached to the first portion and the second portion for retaining the first portion and the second portion in a skating position, the first portion and the second portion being foldable in a direction opposite to the tensioning forces to rest within the third portion and wherein the cable becomes slack to permit resting.

11. The skateboard of claim 10 wherein each at least one ground engaging wheel includes a center axis and further comprising a deck, the deck lying substantially within a plane containing each center axis of the at least one ground engaging wheel of the first and second portions.

12. The skateboard of claim 10 and further comprising a deck, the deck lying substantially within a plane containing each center axis of the at least one ground engaging wheel of the first and second portions.

13. The method of claim 12 wherein the deck rigidly attaches to the third portion.

14. The skateboard of claim 10 and further comprising a dampening system to selectively control the ease the of steering the skateboard.

15. The skateboard of claim 14 wherein the dampening system comprises:

an adjustable member;

a first moveable member engaging the adjustable member;

a spring engaging the first moveable member;

a second moveable member, the spring disposed between the first moveable member and the second moveable member;

an axial member, the second moveable member engaging the axial member; and a pin, the axial member pivotable about the pin;

wherein the adjustable member urges the first moveable member against the spring, the spring urging the second member against the axial member varying the ease at which the axial member pivots about the pin.

16. The skateboard of claim 15 wherein the force exerted by the spring may be varied by increasing or decreasing the length of the adjustable member.

17. The skateboard of claim 14 wherein the dampening method comprises:

an axial attached to the at least one ground engaging wheel;

an extensible member disposed within the axial; and a compressible member, the extensible member engaging the compressible member;

wherein varying the length of the extensible member varies the ease of steering the at least one ground engaging wheel.

18. The skateboard of claim 10 wherein the tension mechanism comprises a non-elastic member attachable to the first portion and the second portion to retain each portion in a skating position.

19. A skateboard comprising a foldable truss-like structure that includes:

a forward portion, a middle portion and a rearward portion, the forward and rearward portions being rotatably attached to the middle portion, wherein the forward portion and the rearward portion nest within the middle portion while in the folded position; and a cable attached to the rearward portion at one end and to the forward portion at another end such that the cable when in tension retains the skateboard in a skating arrangement and wherein the cable becomes slack when the forward and rearward portions are nested within the middle portion.

20. The skateboard of claim 19 comprising a brake connected to the truss-like structure for engaging a rearward wheel or the ground or both to apply a braking force thereon.

21. The skateboard of claim 19 wherein the forward portion includes at least one ground engaging wheel having a first axis; wherein the rearward portion includes at least one ground engaging wheel having a second axis; wherein the middle portion includes a deck to support a foot thereon; and wherein the first axis, the second axis and the deck lie substantially in the same plane.

22. The skateboard of claim 21 and further comprising a brake connected to the rearward portion for engaging the at least one rearward wheel and/or the ground to apply a braking force.

23. The skateboard of claim 19 and further comprising a dampening system to selectively control the ease of steering the skateboard.

24. The skateboard of claim 23 wherein the dampening system comprises:

an adjustable member;

a first moveable member engaging the adjustable member;

a spring engaging the first moveable member;

a second moveable member, the spring disposed between the first moveable member and the second moveable member;

an axial member, the second moveable member engaging the axial member; and a pin, the axial member pivotable about the pin;

wherein the adjustable member urges the first moveable member against the spring, the spring urging the second member against the axial member varying the ease at which the axial member pivots about the pin.

25. The skateboard of claim 24 wherein the force exerted by the spring maybe varied by increasing or decreasing the length of the adjustable member.

26. The skateboard of claim 23 wherein the dampening mechanism comprises:

an axial attached to the at least one ground engaging wheel;

an extensible member disposed within the axial;

a compressible member, the extensible member engaging the compressible member; and wherein varying the length of the extensible member varies the ease of steering the at least one ground engaging wheel.

27. A skateboard comprising:

a foot platform;

front ground engaging wheels connected to the foot platform;

rear ground engaging wheels connected to the foot platform; and an adjustable dampening mechanism comprising:

an adjustable member;

a first moveable member engaging the adjustable member;

a spring engaging the first moveable member;

a second moveable member, the spring disposed between the first moveable member and the second moveable member;

an axial member, the second moveable member engaging the axial member; and a pin, the axial member pivotable about the pin;

wherein the adjustable member urges the first moveable member against the spring, the spring urging the second member against the axial member varying the force at which the axial member pivots about the pin.

28. The skateboard of claim 27 wherein the force exerted by the spring may be varied by increasing or decreasing the length of the adjustable member.

29. The skateboard of claim 27 where the dampening mechanism comprises:

an axial attached to at least one ground engaging wheel;

an extensible member disposable within the axial;

a compressible member, the extensible member engaging the compressible member;

wherein varying the length of the extensible member varies the force for steering the front wheels.

30. The skateboard of claim 27 wherein each of the front and rear ground engaging wheels each include an axis wherein the axis and the foot platform lies substantially in the same plane.

31. The skateboard of claim 27 further comprising:

a front portion, the front ground engaging wheels and dampening mechanism being attached thereto; and a rear portion, the rear ground engaging wheels being attached thereto;

wherein the front portion and the rear portion are positionable from a first skating position to a second folded position.

32. The skateboard of claim 31 and further comprising a middle portion, the foot platform disposed therebetween, wherein the front portion and the rear portion are rotatably attached to the middle portion.

33. The skate of claim 32 wherein the front and rear portions rotate about the middle portion when moving between the first and second positions.

34. The skateboard of claim 31 wherein the front portion and the rear portion are moveable towards each other from the first position to the second position.

35. The skateboard of claim 31 and further comprising a tensioning mechanism to retain the front portion and the rear portion in the first position.

36. The skateboard of claim 35 wherein the tensioning mechanism comprises a non-elastic member attachable to the front and rear portions.

37. The skateboard of claim 31 or 36 and further comprising a locking mechanism to lock and retain the front portion and the rear portion in the first position.

38. The skateboard of claim 31 and further comprising a brake connected to the rearward portion for engaging the rearward wheels or the ground or both to apply a braking force.

* * * * *